US009965990B2

(12) United States Patent
Son et al.

(10) Patent No.: US 9,965,990 B2
(45) Date of Patent: May 8, 2018

(54) DISPLAY APPARATUS HAVING IMPROVED SUB-PIXEL RENDERING CAPABILITY

(71) Applicant: SAMSUNG DISPLAY CO., LTD., Yongin, Gyeonggi-Do (KR)

(72) Inventors: Seokyun Son, Yongin-si (KR); Jai-hyun Koh, Hwaseong-si (KR); Kuk-hwan Ahn, Hwaseong-si (KR); Iksoo Lee, Seoul (KR)

(73) Assignee: SAMSUNG DISPLAY CO., LTD. (KR)

( * ) Notice: Subject to any disclaimer, the term of this patent is extended or adjusted under 35 U.S.C. 154(b) by 83 days.

(21) Appl. No.: 14/928,829

(22) Filed: Oct. 30, 2015

(65) Prior Publication Data

US 2016/0125784 A1 May 5, 2016

(30) Foreign Application Priority Data

Oct. 31, 2014 (KR) ..... 10-2014-0150487

(51) Int. Cl.
*G09G 3/20* (2006.01)
*G09G 3/36* (2006.01)

(52) U.S. Cl.
CPC ..... *G09G 3/2003* (2013.01); *G09G 3/3607* (2013.01); *G09G 2300/0452* (2013.01); *G09G 2320/0666* (2013.01); *G09G 2340/06* (2013.01)

(58) Field of Classification Search
None
See application file for complete search history.

(56) References Cited

U.S. PATENT DOCUMENTS

2004/0223005 A1* 11/2004 Lee ..... G09G 3/3607 345/690
2011/0057950 A1* 3/2011 Kim ..... G09G 5/02 345/602
2012/0320173 A1* 12/2012 Kim ..... G02F 1/13363 348/60
2014/0313112 A1* 10/2014 Madhusudan ..... G09G 3/3208 345/83
2014/0375625 A1* 12/2014 Watanabe ..... G09G 3/3614 345/213

FOREIGN PATENT DOCUMENTS

KR 10-2011-0026225 A 3/2011
KR 10-1097922 B1 12/2011
KR 10-1119169 B1 3/2012
WO 2008100826 A1 8/2008

* cited by examiner

*Primary Examiner* — Christopher Kohlman
(74) *Attorney, Agent, or Firm* — Innovation Counsel, LLP

(57) ABSTRACT

A display apparatus includes a display panel including a first pixel configured to include first and second sub-pixels and a second pixel configured to include third and fourth sub-pixels. A timing controller generates pixel data including first and second pixel data respectively corresponding to the first and second pixels and representable in a second matrix space, from pixel signals including first and second pixel signals representable in a first matrix space to respectively correspond to the first and second pixels. The timing controller generates the second pixel data on the basis of the first pixel signal adjacent to the second pixel signal which correspond to each second pixel data in the column direction in the first matrix space.

30 Claims, 26 Drawing Sheets

DISPLAY APPARATUS HAVING IMPROVED SUB-PIXEL RENDERING CAPABILITY

CROSS-REFERENCE TO RELATED APPLICATION

This U.S. non-provisional patent application claims priority under 35 U.S.C. §119 to Korean Patent Application No. 10-2014-0150487, filed on Oct. 31, 2014, the contents of which are hereby incorporated by reference in their entirety.

BACKGROUND

1. Field of Disclosure

The present disclosure relates generally to a display apparatus. More specifically, the present disclosure relates to display apparatuses with improved sub-pixel rendering capability.

2. Description of the Related Art

In general, a display apparatus displays colors using three primary colors which are typically red, green, and blue. Accordingly, such a display panel typically includes red, green, and blue sub-pixels respectively displaying the red, green, and blue colors. In recent years, the display panel further includes a white sub-pixel to improve brightness of images displayed in the display panel.

The display apparatus employing the above-mentioned structure renders input image signals. Therefore, the input image signals configured to include red, green, and blue input image signals are converted to image data configured to include red, green, blue, and white pixel data, and thus the brightness of the images displayed in the display panel is improved.

SUMMARY

Embodiments of the present disclosure provide a display apparatus having improved display quality.

Embodiments of the inventive concept provide a display apparatus including a display panel, a timing controller, and a data driver. The display panel comprises a plurality of gate lines which extend in a row direction, a plurality of data lines which extend in a column direction, and a plurality of pixels arranged in a matrix form. The pixels comprise first pixels and second pixels respectively disposed adjacent to the corresponding first pixels in the column direction, each of the first pixels comprising first and second sub-pixels sequentially arranged along the column direction and each of the second pixels comprising third and fourth sub-pixels sequentially arranged in the column direction. The timing controller generates pixel data from pixel signals comprising first and second pixel signals representable in a first matrix space to respectively correspond to the first and second pixels, the pixels data comprising first and second pixel data representable in a second matrix space to respectively correspond to the first and second pixels, the second pixel data generated on the basis of first pixel signal. The data driver converts the first and second pixel data to first and second data voltages, respectively, and to apply the first and second data voltages to the first and second pixels.

Embodiments of the inventive concept further provide a display apparatus including a display panel, a timing controller, and a gate driver. The display panel comprises a plurality of gate lines which extend in a first direction, a plurality of data lines which extend in a second direction, and a plurality of pixels arranged in a matrix form. The pixels comprise first pixels and second pixels respectively disposed adjacent to the corresponding first pixels in the first direction, each of the first pixels comprise first and second sub-pixels sequentially arranged along the first direction and each of the second pixels comprising third and fourth sub-pixels sequentially arranged along the first direction. The timing controller is constructed to generate pixel data from pixel signals comprising first and second pixel signals representable in a first matrix space to respectively correspond to the first and second pixels. The pixel data comprise first and second pixel data representable in a second matrix space to respectively correspond to the first and second pixels. The second pixel data is generated on the basis of first pixel signal. The gate driver is constructed to sequentially apply gate signals to the gate lines and output the gate signals to allow pixel signals of an r-th (r is a natural number) row of the first matrix space to be applied to pixels arranged in an r-th row among the pixels, wherein the timing controller is further constructed to perform a reflection operation on the pixel data about an imaginary line which crosses a center of the second matrix space and which is oriented substantially parallel to the second direction and to output the reflected pixel data.

According to the above, the image quality displayed by display apparatus may be prevented from deteriorating during the sub-pixel rendering process. Thus, the image display quality of the display apparatus is improved.

BRIEF DESCRIPTION OF THE DRAWINGS

The above and other advantages of the present disclosure will become readily apparent by reference to the following detailed description when considered in conjunction with the accompanying drawings wherein.

DETAILED DESCRIPTION

Figure 1:
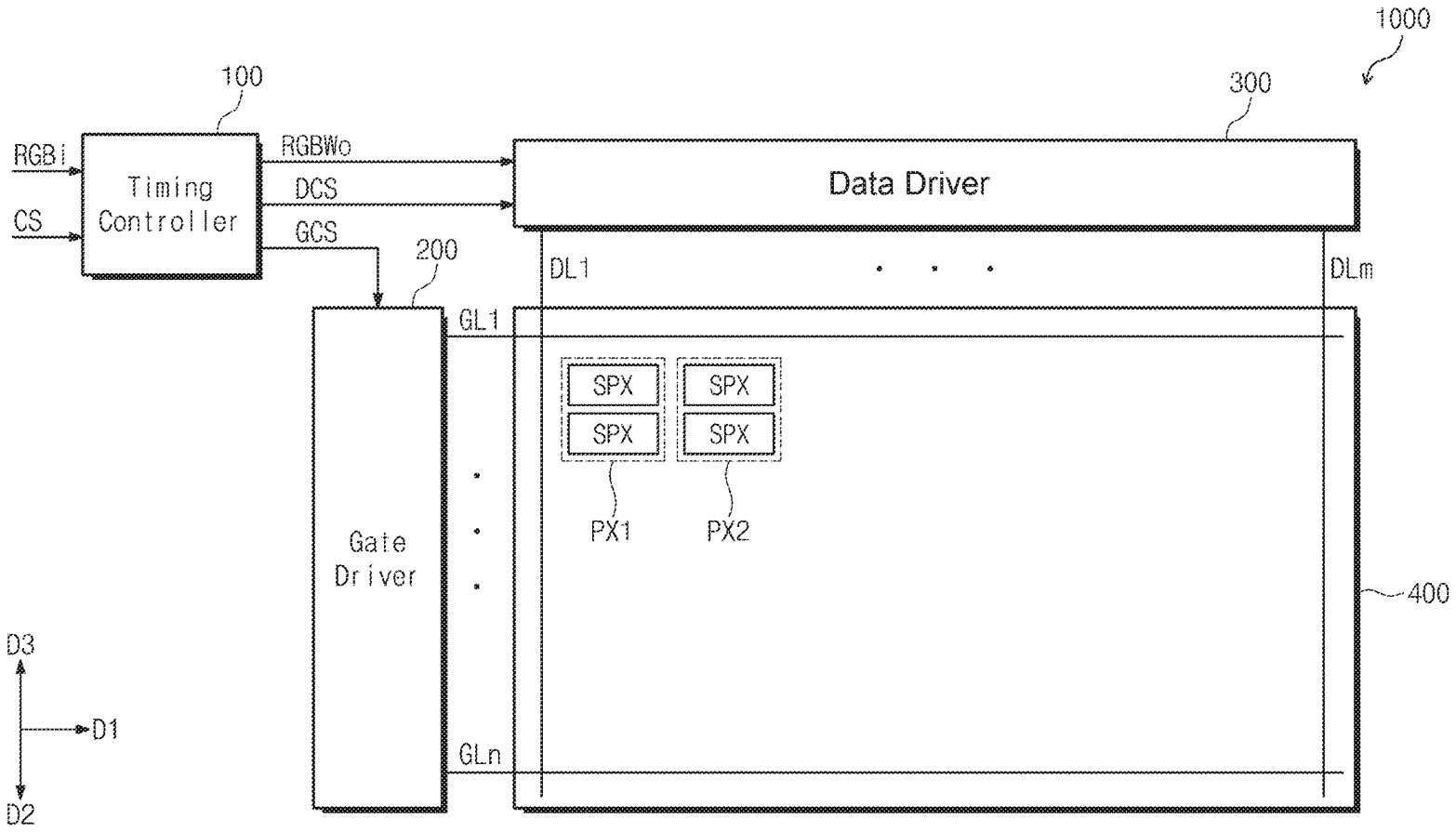
FIG. 1 is a block diagram showing a display apparatus according to an exemplary embodiment of the present disclosure.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The Figures are not to scale. All numerical values are approximate, and may vary. All examples of specific materials and compositions are to be taken as nonlimiting and exemplary only. Other suitable materials and compositions may be used instead.

Hereinafter, the present invention will be explained in detail with reference to the accompanying drawings.

FIG. 1 is a block diagram showing a display apparatus 1000 according to an exemplary embodiment of the present disclosure.

Referring to FIG. 1, the display apparatus 1000 includes a display panel 400 to display an image, gate and data drivers 200 and 300 to drive the display panel 400, and a timing controller 100 to control driving of the gate driver 200 and the data driver 300.

The timing controller 100 receives input image information RGBi and a plurality of control signals CS from an external source (not shown). The timing controller 100 converts the input image information RGBi to a format appropriate to the data driver 300 to generate output image data RGBWo, and applies the output image data RGBWo to the data driver 300.

The timing controller 100 generates a data control signal DCS, e.g., an output start signal, a horizontal start signal, etc., and a gate control signal GCS, e.g., a vertical start signal, a vertical clock signal, a vertical clock bar signal, etc., on the basis of the control signals CS.

The gate driver 200 sequentially outputs gate signals in response to the gate control signal GCS provided from the timing controller 100.

The data driver 300 converts the output image data RGBWo to data voltages in response to the data control signal DCS provided from the timing controller 100. The data voltages are applied to the display panel 400.

The display panel 400 includes a plurality of gate lines GL1 to GLn, a plurality of data lines DL1 to DLm, and a plurality of pixels.

The pixels are used as basic units to display the image, and a resolution of the display panel 400 is determined according to the number, size, and arrangement of the pixels.

In the present exemplary embodiment, the pixels include first and second pixels PX1 and PX2. FIG. 1 shows one first pixel PX1 and one second pixel PX2 as a representative example, although any number and arrangement of pixels are contemplated.

The gate lines GL1 to GLn extend in a first direction D1, and are arranged successively along a second direction D2 substantially perpendicular to the first direction D1 to be substantially parallel to each other. The gate lines GL1 to GLn are connected to the gate driver 200 to receive the gate signals from the gate driver 200. The gate signals are sequentially applied to the gate lines GL1 to GLn in order along the second direction D2.

Each of the first and second pixels PX1 and PX2 includes at least two sub-pixels SPX arranged successively along the second direction D2. Each sub-pixel SPX has a substantially rectangular shape defined by long sides extending in the first direction D1 and short sides extending in the second direction D2. The long sides of the sub-pixels SPX are longer than the short sides of the sub-pixels SPX. The first and second pixels PX1 and PX2 will be described in more detail with reference to FIG. 3.

The data lines DL1 to DLm extend in the second direction D2 and are arranged successively along the first direction D1 to be substantially parallel to each other. The data lines DL1 to DLm are connected to the data driver 300 to receive the data voltages from the data driver 300.

Each of the sub-pixels SPX includes a thin film transistor (not shown) and a liquid crystal capacitor (not shown) in known manner, and is connected to a corresponding gate line of the gate lines GL1 to GLn and a corresponding data line of the data lines DL1 to DLm. In more detail, the sub-pixels SPX are turned on or turned off in response to the gate signals applied thereto. The turned-on sub-pixels SPX display gray-scales corresponding to the data voltages applied thereto.

The display panel 400 may be implemented as any one of a variety of display panels, such as an organic light emitting display panel, a liquid crystal display panel, a plasma display panel, an electrophoretic display panel, an electrowetting display panel, etc. When a liquid crystal display panel is used as the display panel 400, the display apparatus 1000 further includes a backlight unit disposed at a rear side of the display panel 400 to provide a light to the display panel 400.

Figure 2:
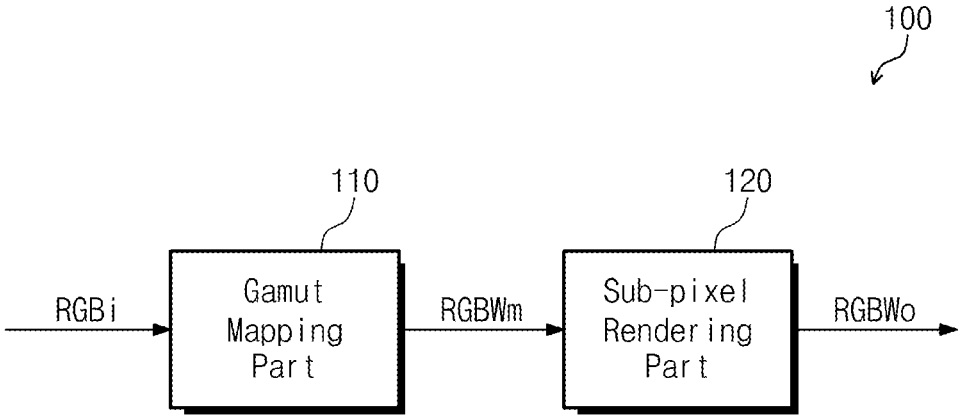
FIG. 2 is a block diagram showing further details of a timing controller shown in FIG. 1.

FIG. 2 is a block diagram showing further details of the timing controller 100 shown in FIG. 1.

Referring to FIG. 2, the timing controller 100 includes a gamut mapping part 110 and a sub-pixel rendering part 120.

The gamut mapping part 110 maps the input image information RGBi to an RGBW signal RGBWm. The gamut mapping part 110 performs a gamut mapping algorithm (GMA) on the input image information RGBi to map an RGB gamut of the input image information RGBi to an RGBW gamut and to thereby generate the RGBW signal RGBWm. The RGBW signal RGBWm is applied to the sub-pixel rendering part 120.

Although not shown in FIG. 2, the gamut mapping part 110 may further generate brightness data of the input image information RGBi in addition to the RGBW signal RGBwm. The brightness data is provided to the sub-pixel rendering part 120 and used in, for example, a sharpening filtering operation.

The sub-pixel rendering part 120 performs a rendering operation on the RGBW signal RGBWm to generate the output image data RGBWo. The rendering operation performed by the sub-pixel rendering part 120 may include, for example, a re-sample filtering operation and a sharpening filtering operation.

Although not shown in FIG. 2, an input gamma converting part may be further disposed at a position prior to the gamut mapping part 110. The input gamma converting part adjusts a gamma characteristic of the input image information RGBi to allow the image data to be more easily processed in the gamut mapping part 110 and the sub-pixel rendering part 120. In more detail, the input gamma converting part linearizes the input image information RGBi such that a non-linear gamma characteristic of the input image information RGBi is in proportion to the brightness.

In addition, an output gamma converting part may be further disposed at a position after the sub-pixel rendering part 120. The output gamma converting part performs a reverse gamma correction on the output image data RGBWo to non-linearize the output image data RGBWo. These input and output gamma converting parts, and their operations, are known.

Figure 3:
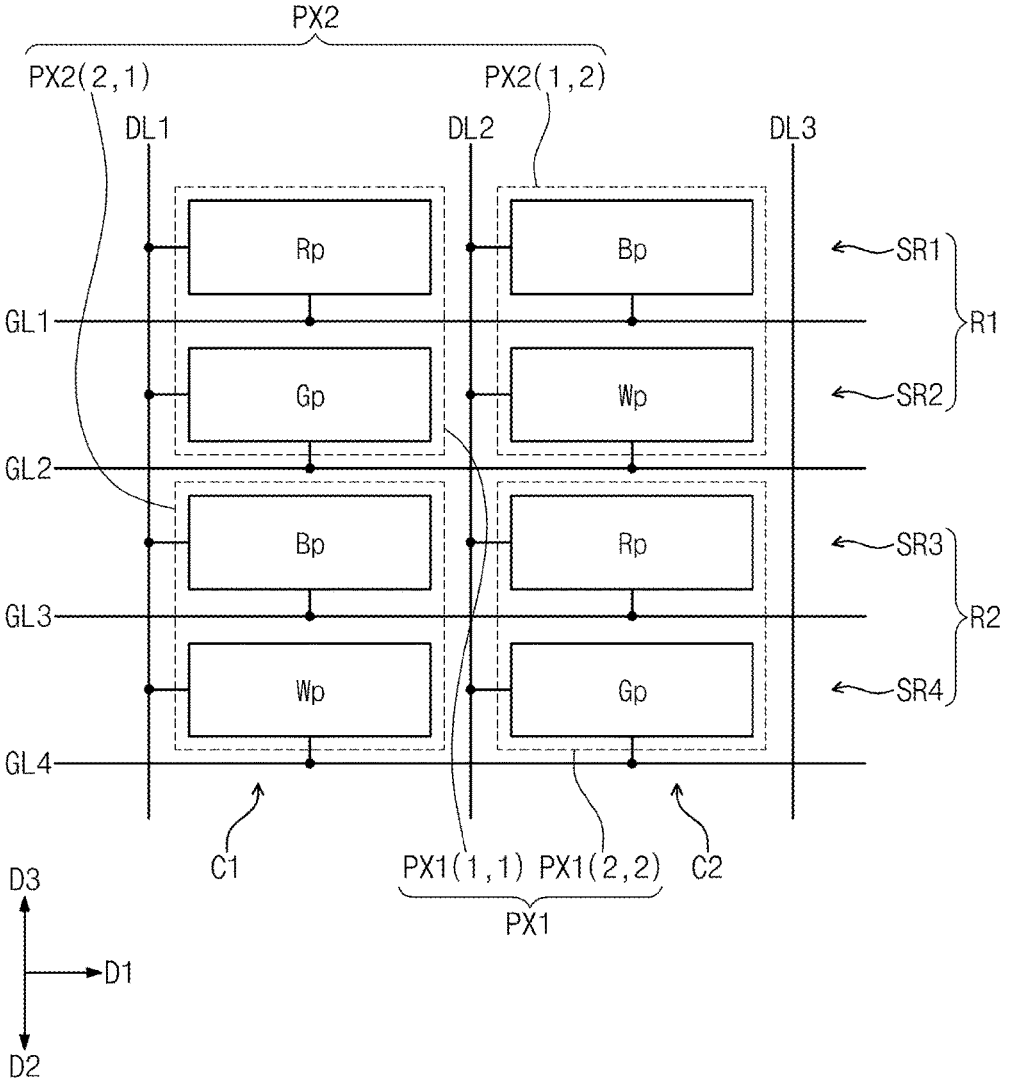
FIG. 3 is a view showing first and second pixel groups of a display panel shown in FIG. 1.

FIG. 3 is a view showing first and second pixels PX1 and PX2 of the display panel 400 shown in FIG. 1, which will now be referred to as pixel groups as, in this embodiment, they each contain multiple pixels.

Referring to FIG. 3, the first and second pixel groups PX1 and PX2 are arranged in a matrix form comprising pixel rows and pixel columns. The pixel rows and the pixel columns are defined on the display panel 400 (refer to FIG. 1). The pixel columns extend in the second direction D2 and are arranged successively along the first direction D1 to be spaced apart from each other by a predetermined distance, and the pixel rows extend in the first direction D1 and are arranged successively along the second direction D2 to be spaced apart from each other by a predetermined distance. FIG. 3 shows only first and second pixel rows R1 and R2 and only first and second pixel columns C1 and C2, although any number of rows and any number of columns are contemplated.

The first pixel group PX1 includes the first pixel PX1(1,1) arranged in the first pixel row and the first pixel column and the first pixel PX1(2,2) arranged in the second pixel row and the second pixel column. The second pixel PX2 includes the second pixel PX2(1,2) arranged in the first pixel row and the second pixel column and the second pixel PX(2,1) arranged in the second pixel row and the first pixel column.

The first and second pixels PX1(1,1) and PX2(1,2) are sequentially arranged in the first pixel row R1 along the first direction D1, and the second and first pixels PX2(2,1) and PX1(2,2) are sequentially arranged in the second pixel row R2 along the first direction D1.

The first pixel row R1 includes first and second sub-pixel rows SR1 and SR2 and the second pixel row R2 includes third and fourth sub-pixel rows SR3 and SR4.

The first pixels PX1(1,1) and PX1(2,2) are configured to include a first sub-pixel Rp displaying a red color and a second sub-pixel Gp displaying a green color, and the second pixels PX2(1,2) and PX2(2,1) are configured to include a third sub-pixel Bp displaying a blue color and a fourth sub-pixel Wp displaying a white color. The first and second sub-pixels Rp and Gp are sequentially arranged along the second direction D2 and the third and fourth sub-pixels Bp and Wp are sequentially arranged along the second direction D2. That is, the first, second, third, and fourth sub-pixels Rp, Gp, Bp, and Wp of the first pixel column C1 display the colors in order of RGBW along the second direction D2.

However, the arrangement order of the first, second, third, and fourth sub-pixels Rp, Gp, Bp, and Wp should not be limited thereto or thereby. Any order is contemplated. For instance, the first, second, third, and fourth sub-pixels Rp, Gp, Bp, and Wp may be arranged along the second direction D2 to respectively display the colors RBGW or RWBG.

The first, second, third, and fourth sub-pixels Rp, Gp, Bp, and Wp are disposed in areas defined by first to third data lines DL1 to DL3 and first to fourth gate lines GL1 to GL4 crossing the first to third data lines DL1 to DL3. The first, second, third, and fourth sub-pixels Rp, Gp, Bp, and Wp arranged in the first pixel column C1 are disposed between the first and second data lines DL1 and DL2, connected to the first data line DL1, and respectively connected to the first to fourth gate lines GL1 to GL4. Similarly, the first, second, third, and fourth sub-pixels Rp, Gp, Bp, and Wp arranged in the second pixel column C2 are disposed between the second and third data lines DL2 and DL3, connected to the second data line DL2, and respectively connected to the first to fourth gate lines GL1 to GL4.

When the gate signals are sequentially applied to the first and second gate lines GL1 and GL2 and the data voltages are sequentially applied to the sub-pixels connected to the first and second gate lines GL1 and GL2, each of the first and second pixels PX1(1,1) and PX2(1,2) arranged in the first pixel row R1 displays one pixel unit of an image. Then, when the gate signals are sequentially applied to the third and fourth gate lines GL3 and GL4 and the data voltages are sequentially applied to the sub-pixels connected to the third and fourth gate lines GL3 and GL4, each of the first and second pixels PX1(2,1) and PX2(2,2) arranged in the second pixel row R2 displays another pixel unit of the image.

However, at least one sub-pixel of the first, second, third, and fourth sub-pixels Rp, Gp, Bp, and Wp arranged in the first pixel column C1 may be connected to the second data line DL2. For instance, the first, second, third, and fourth sub-pixels Rp, Gp, Bp, and Wp may be alternately connected to the first and second data lines DL1 and DL2. In more detail, the first and third sub-pixels Rp and Bp may be connected to the first data line DL1 and the second and fourth sub-pixels Gp and Wp may be connected to the second data line DL2.

Similarly, at least one sub-pixel of the first, second, third, and fourth sub-pixels Rp, Gp, Bp, and Wp arranged in the second pixel column C2 may be connected to the third data line DL3. For instance, the first, second, third, and fourth sub-pixels Rp, Gp, Bp, and Wp may be alternately connected to the second and third data lines DL2 and DL3. In more detail, the first and third sub-pixels Rp and Bp may be connected to the second data line DL2 and the second and fourth sub-pixels Gp and Wp may be connected to the third data line DL3. Embodiments of the invention contemplate any pattern of connections between the sub-pixels and their respective data lines.

Figure 4:
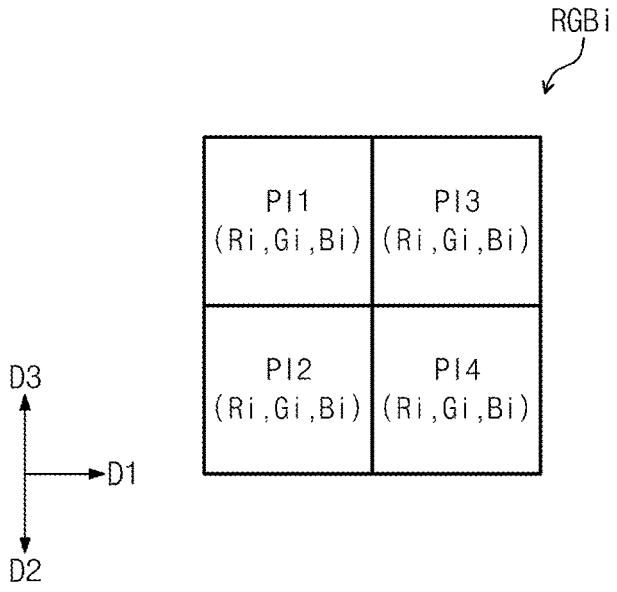
FIG. 4 is a view showing further details of input image information shown in FIG. 2.
Figure 5:
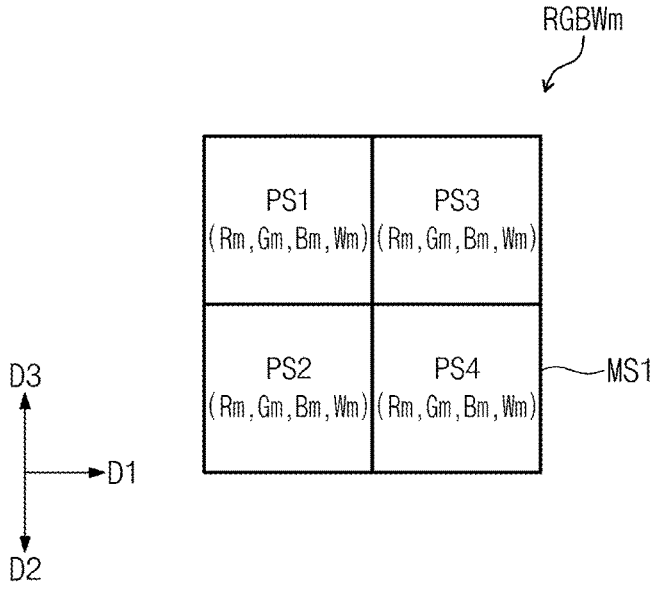
FIG. 5 is a view showing further details of an RGBW signal shown in FIG. 2.
Figure 6:
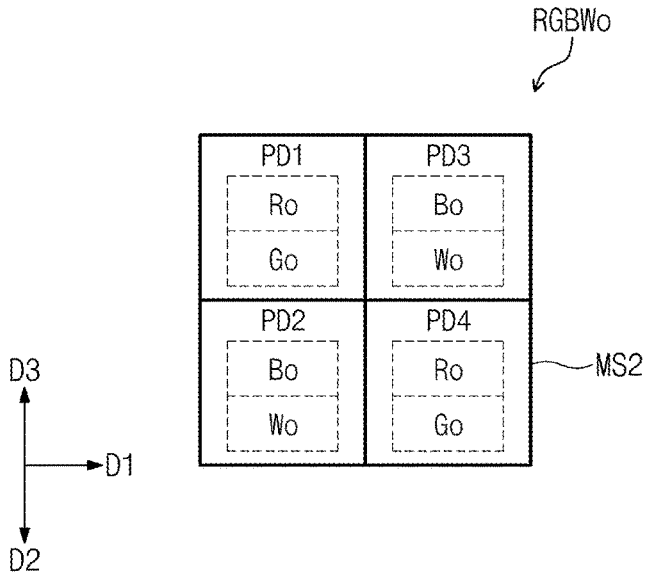
FIG. 6 is a view showing further details of output image data shown in FIG. 2.

FIG. 4 is a view showing further details of the input image information RGBi shown in FIG. 2, FIG. 5 is a view showing further details of the RGBW signal RGBWm shown in FIG. 2, and FIG. 6 is a view showing further details of the output image data RGBWo shown in FIG. 2.

The input image information RGBi includes pixel information corresponding to the first and second pixel groups PX1 and PX2 (refer to FIG. 3). FIG. 4 shows only first to fourth pixel information PI1 to PI4 corresponding to the first and second pixel groups PX1 and PX2 shown in FIG. 3. For convenience of explanation, the pixel information is shown in a matrix representation to correspond to the first and second pixel groups PX1 and PX2. Accordingly, the first pixel information PI1 in the first row and first column of the input image information RGBi corresponds to the pixel of the first pixel group PX1 that is arranged in the first pixel row and the first pixel column. The pixel information in n rows by m columns (each of "n" and "m" is a natural number) corresponds to the pixel of the first pixel group PX1 or the second pixel group PX2 that is arranged in an n-th pixel row and an m-th pixel column.

The input image information RGBi includes information for at least three primary colors. To this end, each pixel information includes a red pixel information Ri, a green pixel information Gi, and a blue pixel information Bi, which respectively have information for red, green, and blue colors, but it should not be limited thereto or thereby. The pixel information may include a pixel information about other colors. For instance, the pixel information may include information on cyan, magenta, and yellow colors.

Referring to FIG. 5, the RGBW signal RGBWm includes pixel signals corresponding to the first and second pixel groups PX1 and PX2. FIG. 5 shows only first to fourth pixel signals PS1 to PS4 corresponding to the first and second pixel groups PX1 and PX2 shown in FIG. 3.

The first to fourth pixel signals PS1 to PS4 may be defined in a matrix representation to correspond to the first and second pixel groups PX1 and PX2. Therefore, the first pixel signal PS1 in the first row and the first column of the RGBW signal RGBWm may correspond to the first pixel PX1(1,1) of the first pixel row and the second pixel column. The pixel signals in n rows by m columns (each of "n" and "m" is a natural number) correspond to the pixel of the first pixel group PX1 or the second pixel group PX2 that is arranged in the n-th pixel row and the m-th pixel column.

The RGBW signal RGBWm includes information about four colors including the white color. To this end, each of the first to fourth pixel signals PS1 to PS4 includes a red pixel signal Rm, a green pixel signal Gm, a blue pixel signal Bm, and a white pixel signal Wm, which respectively have information about red, green, blue, and white colors.

As shown in FIG. 6, the output image data RGBWo include pixel data corresponding to the first and second pixel groups PX1 and PX2. FIG. 6 shows only first to fourth pixel data PD1 to PD4 corresponding to the first and second pixel groups PX1 and PX2 shown in FIG. 3.

The first to fourth pixel data PD1 to PD4 may be represented in a second matrix space MS2 to correspond to the first and second pixel groups PX1 and PX2 arranged in the pixel row and the pixel column. Thus, the first pixel data PD1 in the first row and the first column of the output image data RGBWo may correspond to the first pixel PX1(1,1) of the first pixel row and the first pixel column. The pixel data in n rows by m columns (each of "n" and "m" is a natural number) correspond to the first pixel group PX1 or the second pixel group PX2 arranged in the n-th pixel row and the m-th pixel column.

As described above, the first to fourth pixel data PD1 to PD4 included in the output image data RGBWo are converted to data voltages by the data driver 300 (refer to FIG. 1) and applied to the appropriate pixels of the first pixel group PX1 or the second pixel group PX2. Accordingly, the first and second pixel groups PX1 and PX2 display the image corresponding to the first to fourth pixel data PD1 to PD4.

Each of the first to fourth pixel data PD1 to PD4 includes two different pixel data from among red pixel data Ro, green pixel data Go, blue pixel data Bo, and white pixel data Wo, respectively having information for red, green, blue, and white colors. In more detail, each of the first to fourth pixel data PD1 to PD4 includes two different pixel data from among the red pixel data Ro, the green pixel data Go, the blue pixel data Bo, and the white pixel data Wo in accordance with the color displayed by the corresponding sub-pixels of the first pixel group PX1 or the second pixel group PX2. For instance, each of the first and fourth pixel data PD1 and PD4 includes the red pixel data Ro and the green pixel data Go to correspond to the first pixels PX1(1,1) and PX1(2,2), and each of the second and third pixel data PD2 and PD3 includes the blue pixel data Bo and the white pixel data Wo to correspond to the second pixels PX2(1,2) and PX2(2,1).

Referring to FIGS. 3 to 6, the sub-pixel rendering part 120 (refer to FIG. 2) generates the red and green pixel data Ro and Go of the first and fourth pixel data PD1 and PD4 on the basis of the first and fourth pixel signals PS1 and PS4.

As an example, the red and green pixel data Ro and Go of the first and fourth pixel data PD1 and PD4 are substantially the same as the red and green pixel signals Rm and Gm of the first and fourth pixel signals PS1 and PS4, respectively.

As another example, the red and green pixel data Ro and Go of the first and fourth pixel data PD1 and PD4 may be generated using a re-sample filter RSF (refer to FIG. 10) in which the first and fourth pixel signals PS1 and PS4 are designated as target pixel signals. The data processing operation performed using the re-sample filter RSF will be described in more detail below with reference to FIGS. 7 to 11.

In addition, the sub-pixel rendering part 120 generates the blue pixel data Bo of the second pixel data PD2 in response to the first pixel signal PS1.

In the present exemplary embodiment, the blue pixel data Bo of the second pixel data PD2 may be substantially the same as the blue pixel signal Bm of the first pixel signal PS1.

The blue pixel data Bo of the second pixel data PD2 may be generated by using the re-sample filter RSF with the first pixel signal PS1 being designated as a target pixel signal. The sub-pixel rendering part 120 generates the white pixel data Wo of the second and third pixel data PD2 and PD3 in response to the second and third pixel signals PS2 and PS3.

As an example, the white pixel data Wo of the second and third pixel data PD2 and PD3 may be substantially the same as the white pixel signal Wm of the second and third pixel signals PS2 and PS3.

As another example, the white pixel data Wo of the second and third pixel data PD2 and PD3 may be generated by using the re-sample filter RSF with the second and third pixel signals PS2 and PS3 designated as target pixel signals.

As described above with reference to FIG. 3, since the first pixel group PX1 includes first and second sub-pixels Rp and Gp connected to different gate lines from each other, the data voltages obtained by converting the red and green pixel data Ro and Go corresponding to the first pixel group PX1 are applied to the first and second sub-pixels Rp and Gp during different horizontal periods.

Similarly, since the second pixel group PX2 includes third and fourth sub-pixels Bp and Wp connected to different gate lines, the data voltages obtained by converting the blue and white pixel data Bo and Wo corresponding to the second pixel group PX2 are applied to the third and fourth sub-pixels Bp and Wp during different horizontal periods.

Hereinafter, the rendering operation using the re-sample filter RSF will be described in detail with reference to FIGS. 7 to 9.

Figure 7:
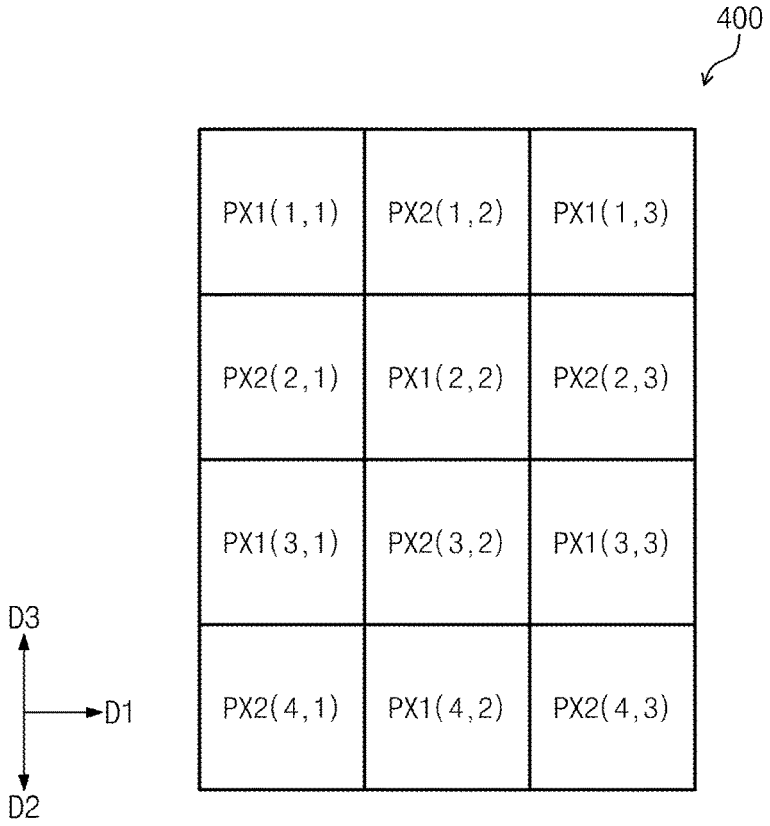
FIG. 7 is a view showing first and second pixels to explain a rendering operation according to an exemplary embodiment of the present disclosure.
Figure 8:
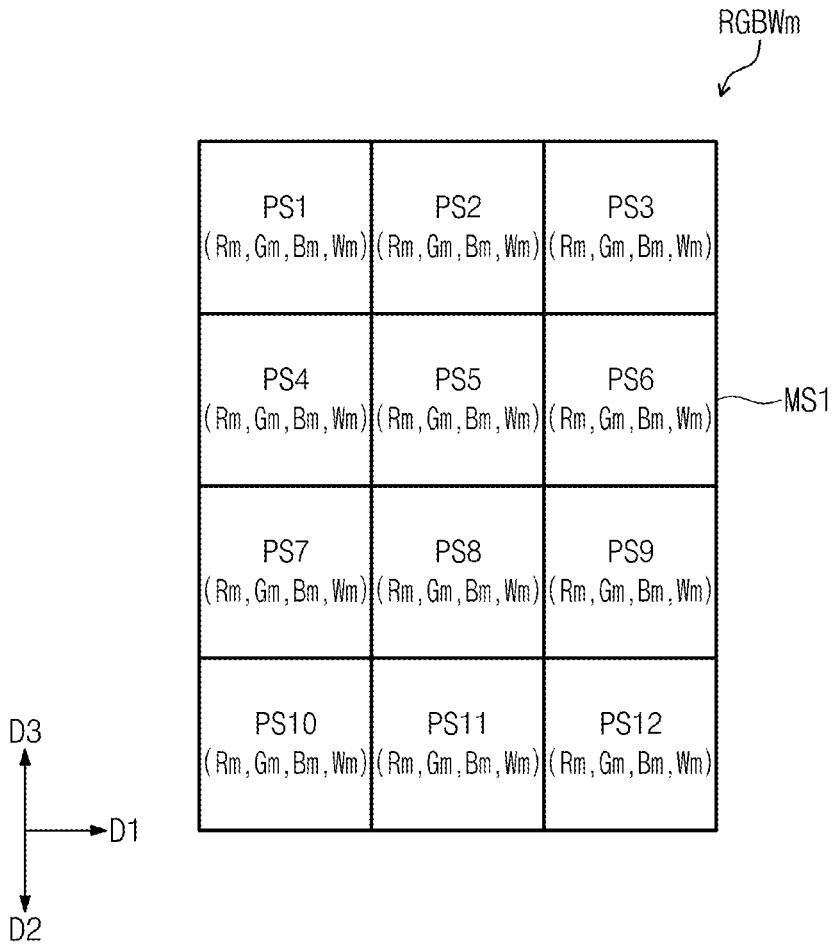
FIG. 8 is a view showing pixel signals to explain a rendering operation according to an exemplary embodiment of the present disclosure.
Figure 9:
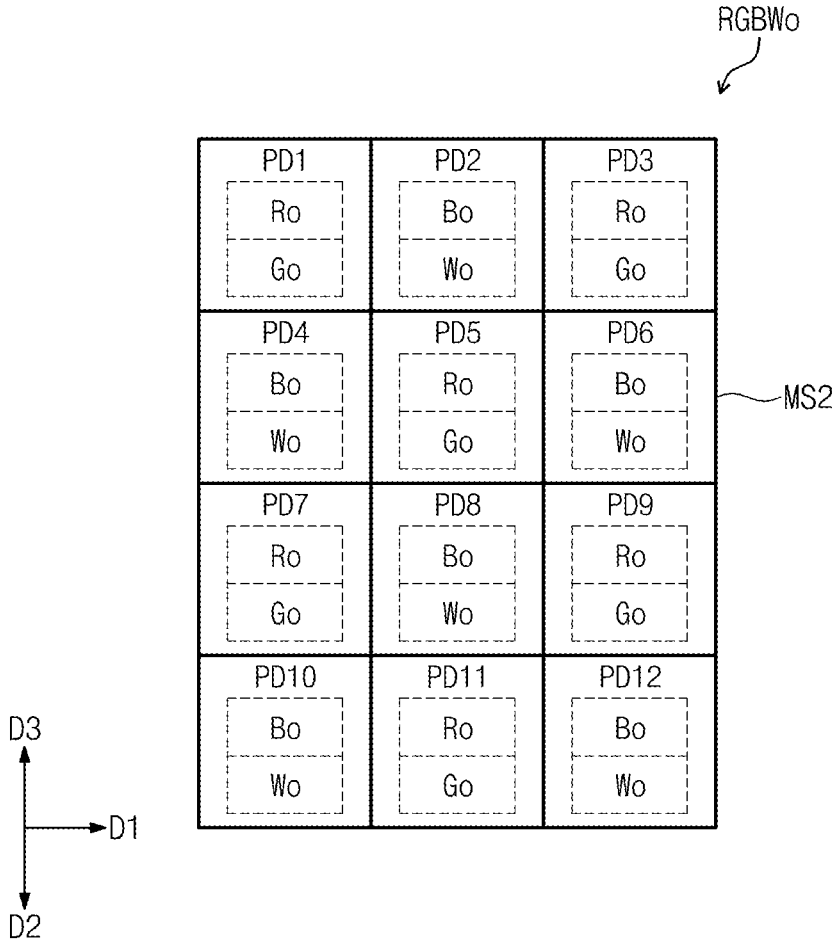
FIG. 9 is a view showing output image data to explain a rendering operation according to an exemplary embodiment of the present disclosure.

FIG. 7 is a view showing first and second pixels to explain the rendering operation according to an exemplary embodiment of the present disclosure, FIG. 8 is a view showing pixel signals to explain the rendering operation according to an exemplary embodiment of the present disclosure, and FIG. 9 is a view showing output image data to explain the rendering operation according to an exemplary embodiment of the present disclosure.

FIG. 7 shows first pixels PX1(1,1), PX1(1,3), PX1(2,2), PX1(3,1), PX1(3,3), and PX1(4,2) and second pixels PX2(1,2), PX2(2,1), PX2(2,3), PX2(3,2), PX4(4,1), and PX(4,3), which are arranged in the matrix configuration having four rows by three columns.

The RGBW signal RGBWm includes the pixel signals provided in the first matrix space MS1 of FIG. 8, and corresponds to the first pixels PX1(1,1) to PX1(4,2) and the second pixels PX2(1,2) to PX2(4,3). The output image data RGBWo includes the pixel data provided in the second matrix space MS2 of FIG. 9, and corresponds to the first and second pixels PX1(1,1) to PX1(4,2) and PX2(1,2) to PX2(4,3).

In more detail, the RGBW signal RGBWm includes first to twelfth pixel signals PS1 to PS12 as shown in FIG. 8, and the output image data RGBWo includes first to twelfth pixel data PD1 to PD12 as shown in FIG. 9.

Figure 10:
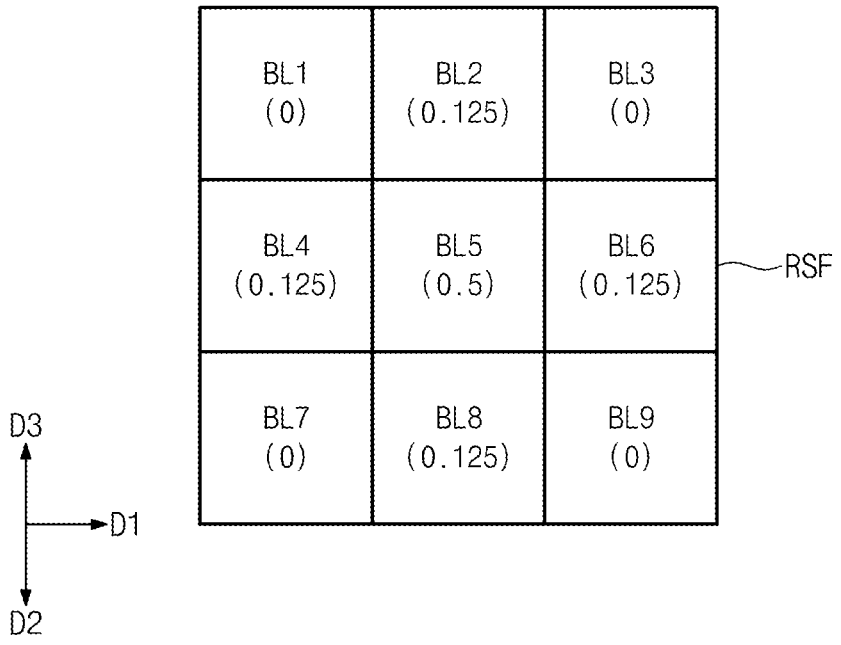
FIG. 10 is a view showing a rendering filter to explain a rendering operation according to an exemplary embodiment of the present disclosure.
Figure 11A:
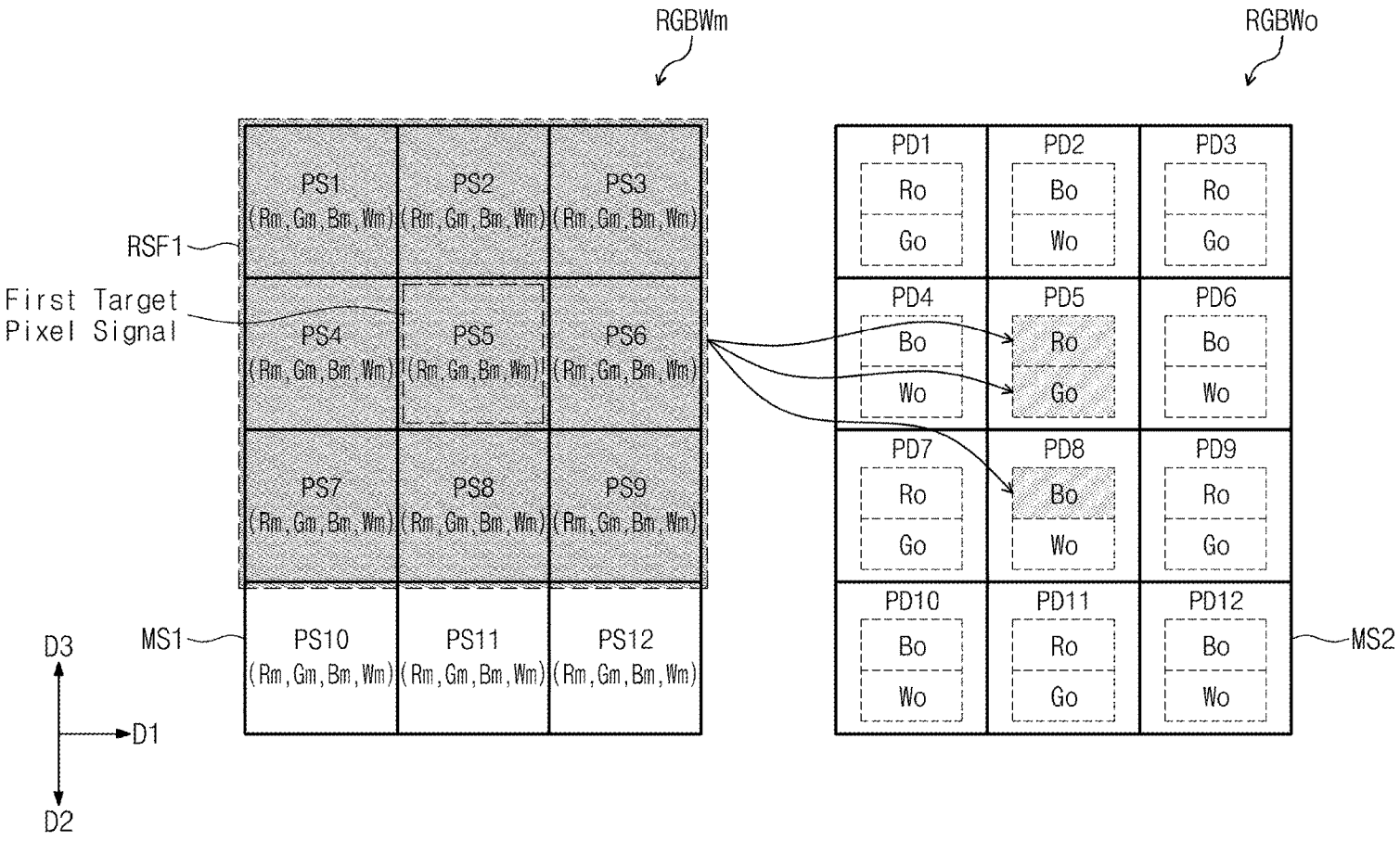
FIGS. 11A and 11B are views showing the generation of pixel data according to an exemplary embodiment of the present disclosure.
Figure 11B:
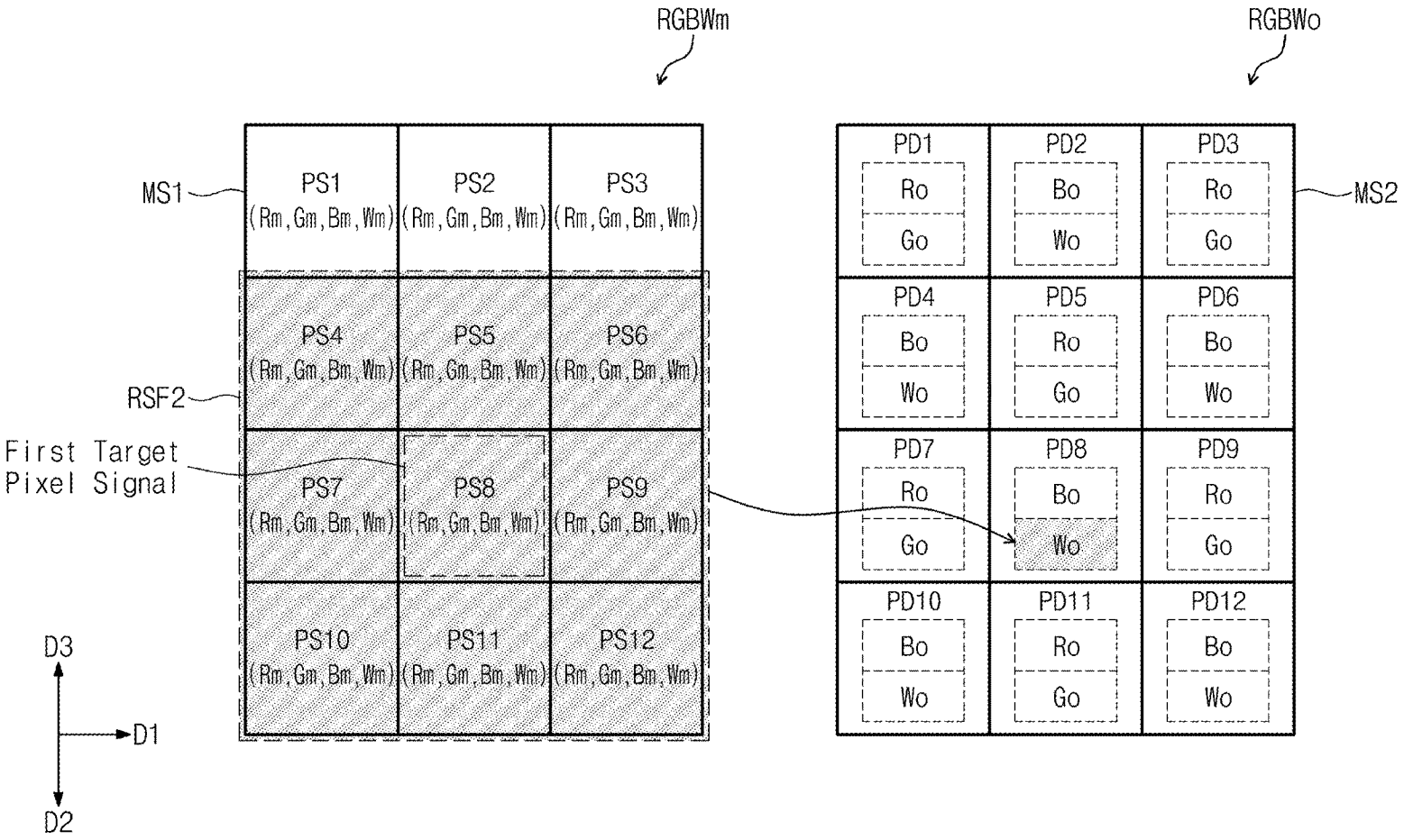

FIG. 10 is a view showing a rendering filter to explain a rendering operation according to an exemplary embodiment of the present disclosure, and FIGS. 11A and 11B are views showing generation of pixel data according to an exemplary embodiment of the present disclosure.

The sub-pixel rendering part 120 (refer to FIG. 2) generates the output image data RGBWo on the basis of the RGBW signal RGBWm. According to the embodiment, the sub-pixel rendering part 120 may generate the output image data RGBWo using a re-sample filtering operation in response to receiving the RGBW signal RGBWm.

The re-sample filtering operation generates the pixel data applied to the target pixel on the basis of the portions RGBW signal RGBWm which correspond to the target pixel and the pixels neighboring to the target pixel. As an example, the re-sample filtering operation may be performed by applying the re-sample filter RSF to the RGBW signal RGBWm.

As shown in FIG. 10, the re-sample filter RSF includes first to ninth blocks BL1 to BL9 arranged in a 3×3 matrix. The first to ninth blocks BL1 to BL9 have scale coefficients. A sum of the scale coefficients of the first to ninth blocks BL1 to BL9 is "1". In the present exemplary embodiment, the scale coefficients of the first to ninth blocks BL1 to BL9 are set to 0, 0.125, 0, 0.125, 0.5, 0.125, 0, 0.125, and 0, respectively.

Hereinafter, the operation of generating the output image data RGBWo will be described in detail with reference to FIGS. 11A and 11B.

The sub-pixel rendering part 120 generates pixel data corresponding to the target pixel using a re-sample filter in which the pixel signal corresponding to the target pixel is designated as the target pixel signal. In this case, when one pixel signal is designated as the target pixel signal, the pixel signal designated as the target pixel signal is multiplied by the scale coefficient of the block defined at a center portion of the re-sample filter, and the signals of the pixels neighboring the pixel corresponding to the target pixel signal are multiplied by the scale coefficients of the blocks neighboring the block defined at the center portion of the re-sample filter.

As an example, the red and green pixel data Ro and Go are generated by applying the re-sample filter RSF where the pixel signals corresponding to the pixel data, to which the red and green pixel data Ro and Go belong, are respectively designated as the target pixel signals.

For instance, the red and green pixel data Ro and Go of the fifth pixel data PD5 corresponding to the first pixel PX1(2,2) of the second pixel row and the second pixel column may be generated by applying a first re-sample filter RSF1 in which the fifth pixel signal PS5 corresponding to the first pixel PX1(2,2) is designated as a first target pixel signal.

In more detail, the red and green pixel data Ro and Go of the fifth pixel data PD5 are determined by values obtained by multiplying the red and green pixel signals Rm and Gm of the fifth pixel signal PS5 and the first, second, third, fourth, sixth, seventh, eighth, and ninth pixel signals PS1, PS2, PS3, PS4, PS6, PS7, PS8, and PS9 neighboring the fifth pixel signal PS5 by corresponding scale coefficients of the re-sample filter RSF.

As another example, the blue pixel data Bo are generated by applying the re-sample filter RSF where the pixel signal neighboring the pixel signal corresponding to the pixel data, to which the blue pixel data Bo belong, in the third direction D3 is designated as the target pixel signal.

For instance, the blue pixel data Bo of the eighth pixel data PD8 corresponding to the second pixel PX2(3,2) of the third pixel row and the second pixel column may be generated by applying the first re-sample filter RSF1 where the fifth pixel signal PS5 corresponding to the first pixel PX1 (2,2) of the second pixel column and the second pixel row is designated as the first target pixel signal.

In more detail, the blue pixel data Bo of the eighth pixel data PD8 are determined by values obtained by multiplying the blue pixel signals Bm of the fifth pixel signal PS5 and the first, second, third, fourth, sixth, seventh, eighth, and ninth pixel signals PS1, PS2, PS3, PS4, PS6, PS7, PS8, and PS9 neighboring to the fifth pixel signal PS5 by corresponding scale coefficients of the first re-sample filter RSF1.

As a further example, the white pixel data Wo are generated by applying the re-sample filter RSF where the pixel signals corresponding to the pixel data, to which the white pixel data Wo belong, are designated as the target pixel signals.

For instance, the white pixel data Wo of the eighth pixel data PD8 corresponding to the second pixel PX2(3,2) of the third pixel row and the second pixel column may be generated by applying a second re-sample filter RSF2 where the eighth pixel signal PS8 corresponding to the second pixel PX2(2,2) of the second pixel column and the third pixel row is designated as a second target pixel signal.

In more detail, the white pixel data Wo of the eighth pixel data PD8 are determined by values obtained by multiplying the white pixel signals Wm of the eighth pixel signal PS8 and the fourth, fifth, sixth, seventh, ninth, tenth, eleventh, and twelfth pixel signals PS4, PS5, PS6, PS7, PS9, PS10, PS11, and PS12 neighboring to the eighth pixel signal PS8 by corresponding scale coefficients of the second re-sample filter RSF2.

The sub-pixel rendering part 120 compensates for the output image data RGBWo by using a sharpening operation after performing the re-filtering operation. In detail, the sharpening filtering operation checks properties of the RGBW signal RGBWm, e.g., line, edge, dot, oblique line, etc., and compensates for the output image data RGBWo to more properly display the line, edge, dot, and oblique line of the RGBW signal RGBWm.

Figure 12A:
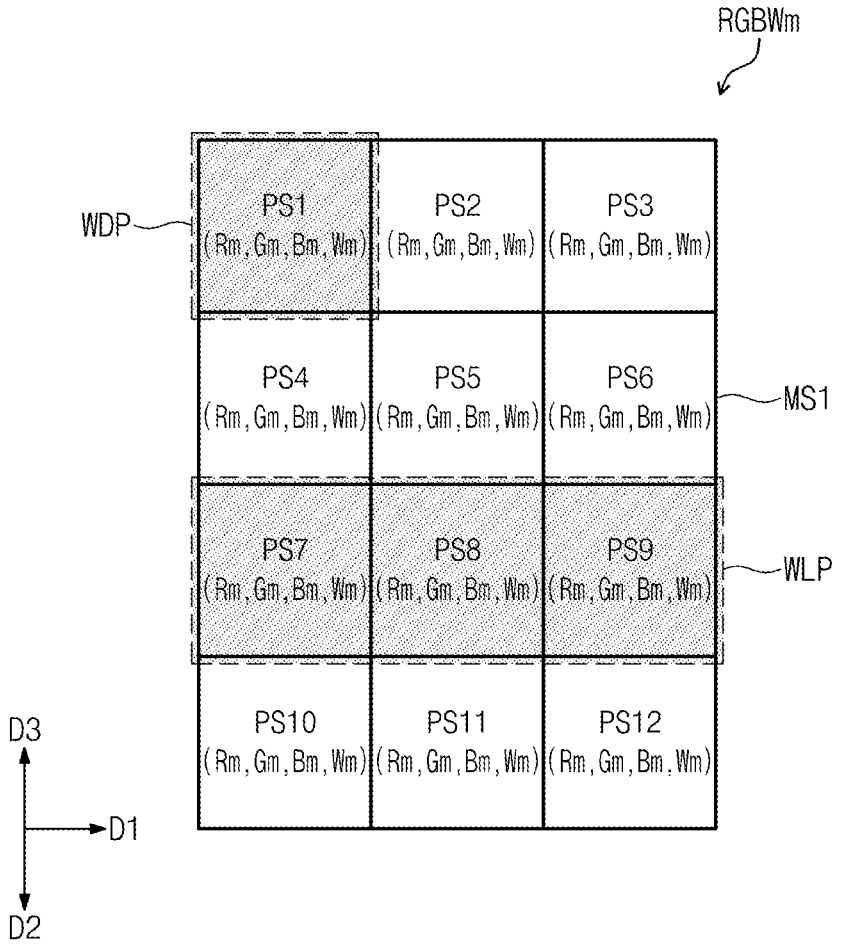
FIG. 12A is a view showing a portion of RGBW signals according to an exemplary embodiment of the present disclosure.
Figure 12B:
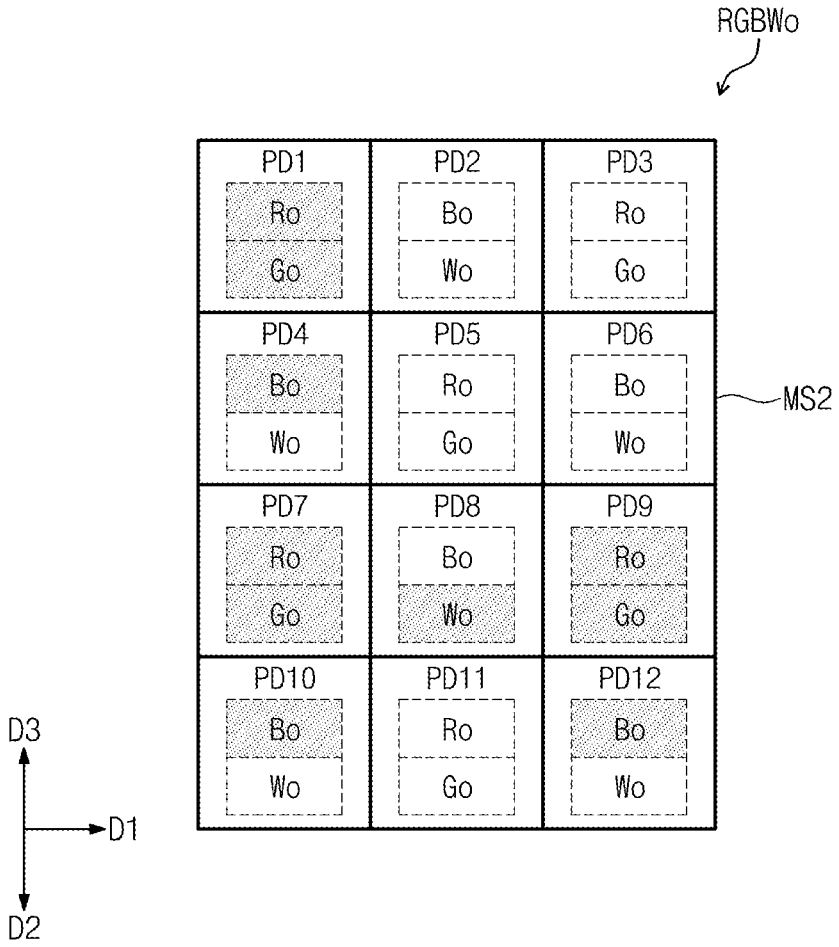
FIG. 12B is a view showing output image data generated on the basis of the RGBW signals shown in FIG. 12A.
Figure 12C:
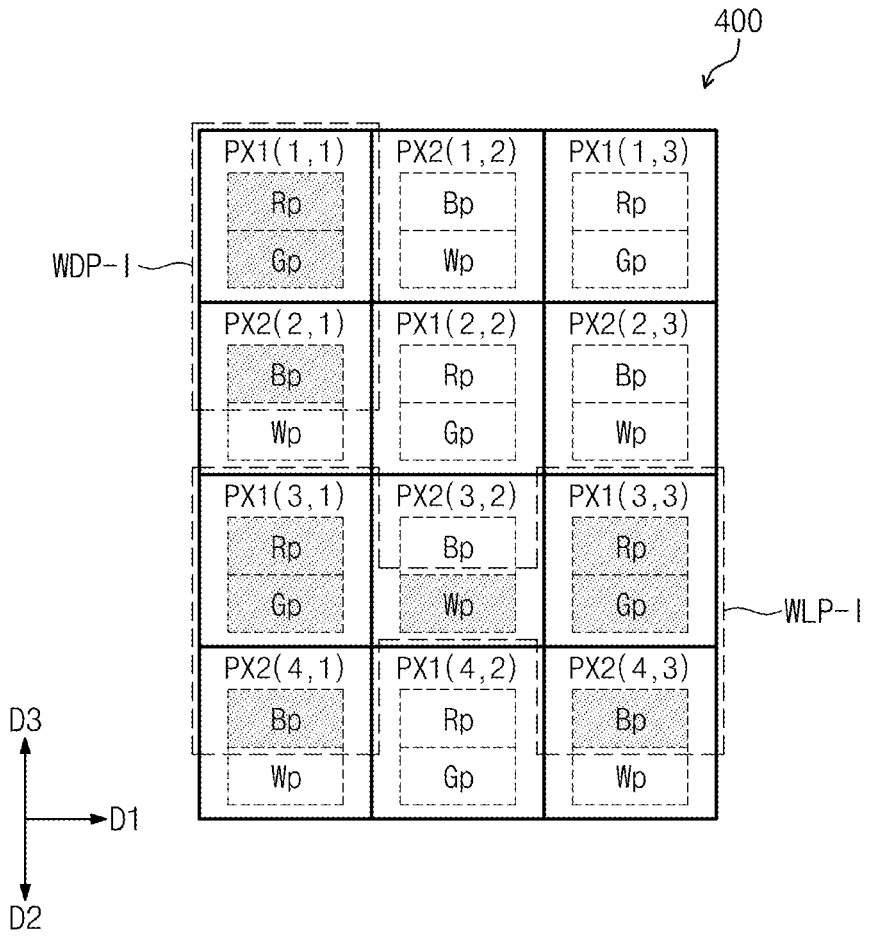
FIG. 12C is a view showing a portion of a display panel that displays an image according to the output image data shown in FIG. 12B.

FIG. 12A is a view showing a portion of RGBW signals according to an exemplary embodiment of the present disclosure, FIG. 12B is a view showing output image data generated on the basis of the RGBW signals shown in FIG. 12A, and FIG. 12C is a view showing a portion of a display panel that displays an image according to the output image data shown in FIG. 12B.

Referring to FIGS. 12A to 12C, the RGBW signal RGBW has a white line pattern WLP extending in a row direction, and a white dot pattern WDP. The white line pattern WLP is positioned to correspond to a third row and the white dot pattern WDP is provided to correspond to a first row and a first column. A value of the pixel signals included in the white line pattern WLP and the white dot pattern WDP corresponds to the white image. For instance, values of the red, green, blue, and white pixel signals Rm, Gm, Bm, and Wm of the pixel signals included in the white line pattern WLP and the white dot pattern WDP corresponds to 255 grayscale.

The pixel signals not included in the white line pattern WLP and the white dot pattern WDP have values corresponding to a black image. For instance, the value of the red, green, blue, and white pixel signals Rm, Gm, Bm, and Wm of the pixel signals not included in the white line pattern WLP and the white dot pattern WDP corresponds to 0 grayscale.

As described above, the output image data RGBWo is generated using the re-sample filter RSF. In more detail, the red and green pixel data Ro and Go of the first, seventh, and ninth pixel data PD1, PD7, and PD9 are generated using the re-sample filter RSF where the red and green pixel signals Rm and Gm of the first, seventh, and ninth pixel signals P51, PS7, and PS9 are designated as the target pixel signal.

The white pixel data Wo of the eighth pixel data PD8 is generated using the re-sample filter RSF where the white pixel signal Wm of the eighth pixel signal PS8 is designated as the target pixel signal.

The blue pixel data Bo of the fourth, tenth, and twelfth pixel data PD4, PD10, and PD12 are generated using the re-sample filter RSF where the blue pixel signals Bm of the first, seventh, and ninth pixel data PD1, PD7, and PD9 are respectively designated as the target pixel signals.

Referring to FIG. 12C, the gate signals are sequentially applied to the first gate line GL1 to the n-th gate line GLn. That is, the gate signals are sequentially applied to the gate lines GL1 to GLn in order.

The data driver 300 applies the pixel data of the output image data RGBWo to the first and second pixels PX1(1,1) to PX1(4,2) and PX2(1,2) to PX2(4,3) by row. Accordingly, the pixels arranged in an r-th row ("r" is a natural number) display the image corresponding to the pixel data of the r-th row of the output image data RGBWo.

As a result, the first, second, third, and fourth sub-pixels Rp, Gp, Bp, and Wp of the display panel 400 are operated in accordance with the output image data RGBWo, to display a white line pattern image WLP-I and a white dot pattern image WDP-I, which respectively correspond to the white line pattern WLP and the white dot pattern WDP. For convenience of explanation, the first, second, third, and fourth sub-pixels Rp, Gp, Bp, and Wp displaying the white line pattern image WLP-I and the white dot pattern image WDP-I are shown as being separate and spaced apart from one another.

In more detail, the red and green images displayed in the first and second sub-pixels Rp and Gp of the second pixel PX2(3,1) of the third pixel row and the first pixel column are added to the blue image displayed in the third sub-pixel Bp of the second pixel PX2(4,1) of the fourth pixel row and the first pixel column, to display a first white image.

The red and green images displayed in the first and second sub-pixels Rp and Gp of the first pixel PX1(3,3) of the third pixel row and the third pixel column are added to the blue image displayed in the third sub-pixel Bp of the second pixel PX2(4,3) of the fourth pixel row and the third pixel column, to display a second white image. As a result, the first and second white images and the white image of the white pixel Wp of the second pixel PX2(3,2) of the third pixel row and the second pixel column form the white line pattern image WLP-I.

Similarly, the red and green images displayed in the first and second sub-pixels Rp and Gp of the first pixel PX1(1,1) of the first pixel row and the first pixel column are added to the blue image displayed in the third sub-pixel Bp of the second pixels PX2(2,1) of the second pixel row and the second pixel column to form the white dot pattern image WDP-I.

In general, the human eye responds much more strongly to red and green colors than to blue. Accordingly, when a white color is displayed, a yellow image perceived through red and green images and a light blue image perceived through the blue and white images are separately recognized, and as a result, the quality of the white image is degraded.

However, when the blue data Bo is generated, the white line pattern image WLP-I and the white dot pattern image WDP-I may be displayed without degrading in display quality as shown in FIG. 12C.

In other words, when a mostly-white pattern such as the white line pattern WLP and the white dot pattern WDP is displayed by the first, second, third, and fourth sub-pixels Rp, Gp, Bp, and Wp sequentially arranged in the column direction, color reproducibility and display quality of the white image may be improved by processing the RGBW signal RGBWm and generating the output image data RGBWo to allow the red, green, and blue images to be sequentially displayed along the column direction.

Figure 13:
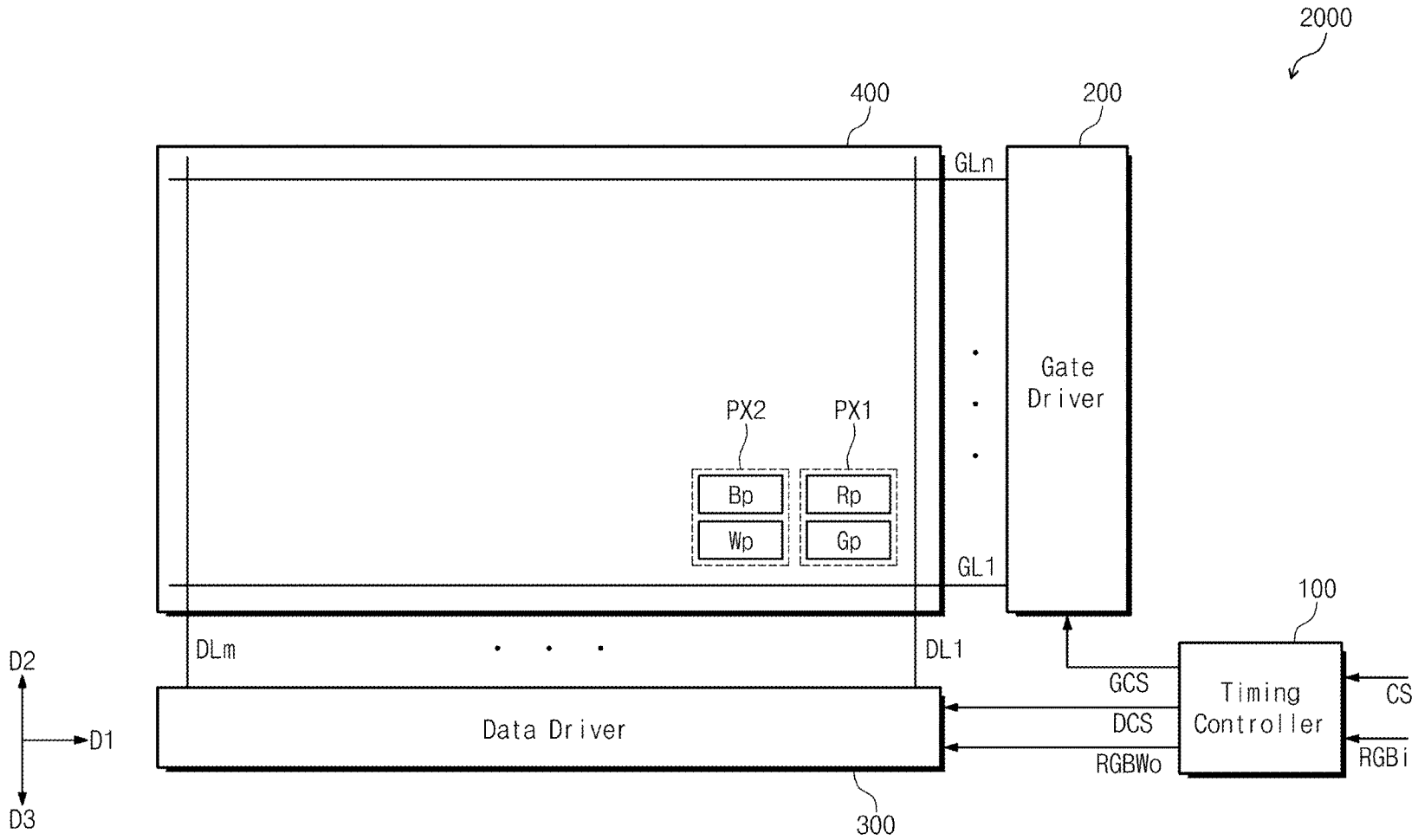
FIG. 13 is a block diagram showing a display apparatus according to another exemplary embodiment of the present disclosure.

FIG. 13 is a block diagram showing a display apparatus 2000 according to another exemplary embodiment of the present disclosure.

Referring to FIG. 13, the display apparatus 2000 is operated in an up-and-down inversion driving scheme. In an up-and-down inversion driving scheme, the image is displayed in the display apparatus 2000 while upper and lower portions of the display apparatus 2000 are reversed with respect to the embodiment of FIG. 1. When viewed in a thickness direction of the display apparatus 2000, the display apparatus 2000 displays the image after being rotated about a center of the display apparatus 2000 at an angle of about 180 degrees. In other words, a first portion of the display panel 400, which is adjacent to the data driver 300, is located at a lower side and a second portion of the display panel 400, which is adjacent to the gate driver 200, is located at a right side when the display apparatus 2000 displays the image.

When the display apparatus 2000 is operated in the up-and-down inversion driving scheme, the timing controller 100 swaps the order of the pixel data of the output image data RGBWo and the gate driver 200 changes the order of the gate signals such that the pixel data of an n-(r+1)th row of the output image data RGBWo correspond to the r-th pixel row ("r" is a natural number, thereby displaying a non-inverted image. Here, "n" is a natural number and indicates the number of rows of the output image data RGBWo.

The display apparatus 2000 includes first and second pixels PX1 and PX2 arranged in areas defined by a plurality of gate lines GL1 to GLn and a plurality of data lines DL1 to DLm.

The first pixel PX1 includes a first sub-pixel Rp and a second sub-pixel Gp, and the second pixel PX2 includes a third sub-pixel Bp and a fourth sub-pixel Wp. The first and second pixels PX1 and PX2 and the first, second, third, and fourth sub-pixels Rp, Gp, Bp, and Wp according to the present exemplary embodiment are similar to those in FIGS. 1 and 3.

Figure 14:
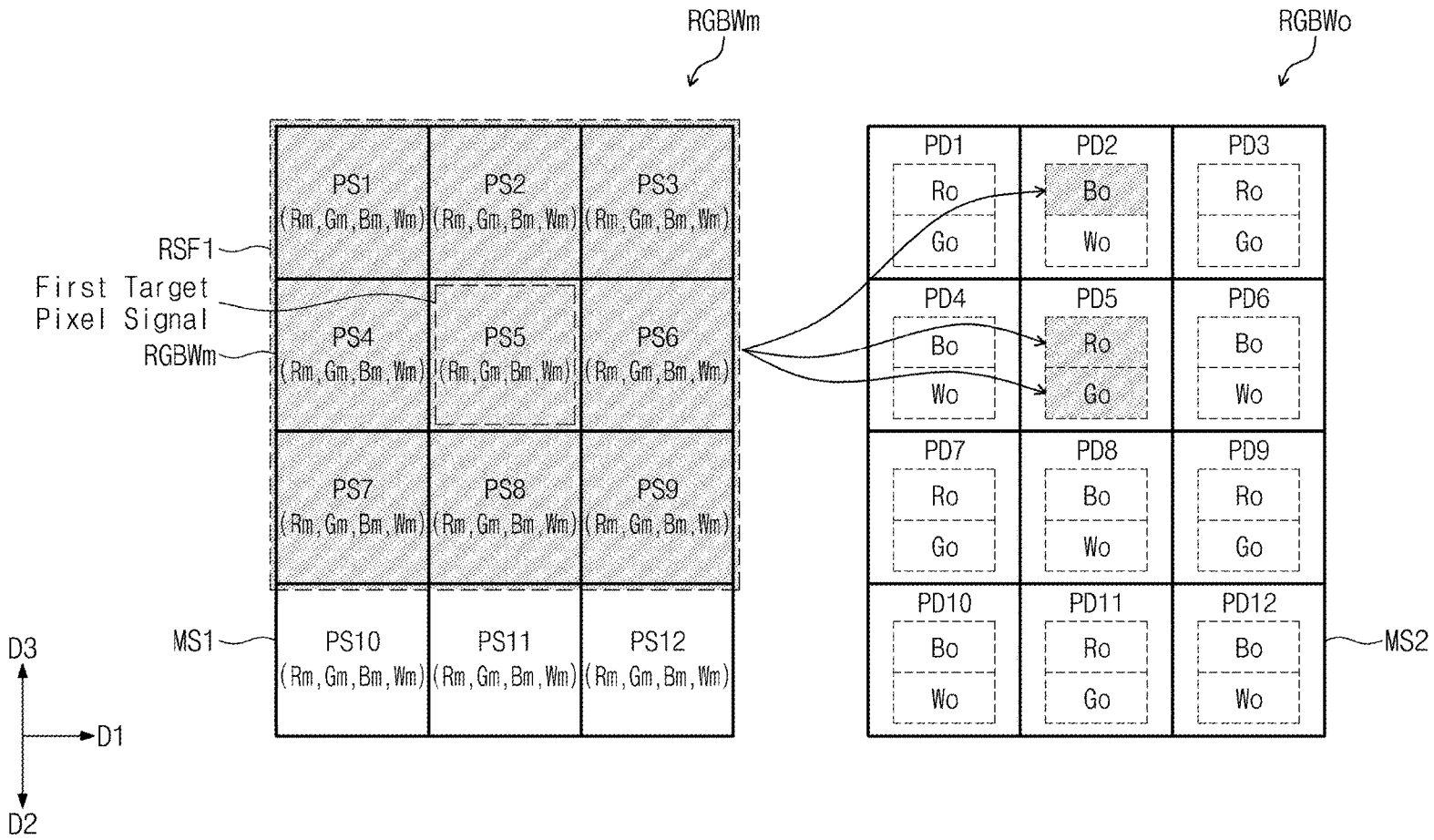
FIG. 14 is a view showing the generation of pixel data according to another exemplary embodiment of the present disclosure.

FIG. 14 is a view showing the generation of pixel data according to another exemplary embodiment of the present disclosure. The generation of pixel data according to the present exemplary embodiment is substantially the same as the generating of pixel data shown in FIGS. 11A and 11B except for the generation of blue pixel data, and thus detailed descriptions of the generation of red, green, and white pixel data will be omitted.

As an example, the blue pixel data Bo may be generated by using a re-sample filter RSF where a pixel signal for a pixel adjacent to that of the blue pixel data Bo in the second direction D2 is designated as a target pixel signal.

For instance, the blue pixel data Bo of the second pixel data PD2 corresponding to the second pixel PX2(1,2) (refer to FIG. 7) of the first pixel row and the second pixel column is generated using a first re-sample filter RSF in which the fifth pixel signal PS5 corresponding to the first pixel PX1 (2,2) of the second pixel row and the second pixel column is designated as a first target pixel signal.

In more detail, the blue pixel data Bo of the second pixel data PD2 is determined by multiplying the blue pixel signal Bm of the fifth pixel signal PS5 and first, second, third, fourth, sixth, seventh, eighth, and ninth pixel signals PS1, PS2, PS3, PS4, PS6, PS7, PS8, and PS9 by scale coefficients corresponding to the first re-sample filter RSF1.

Figure 15A:
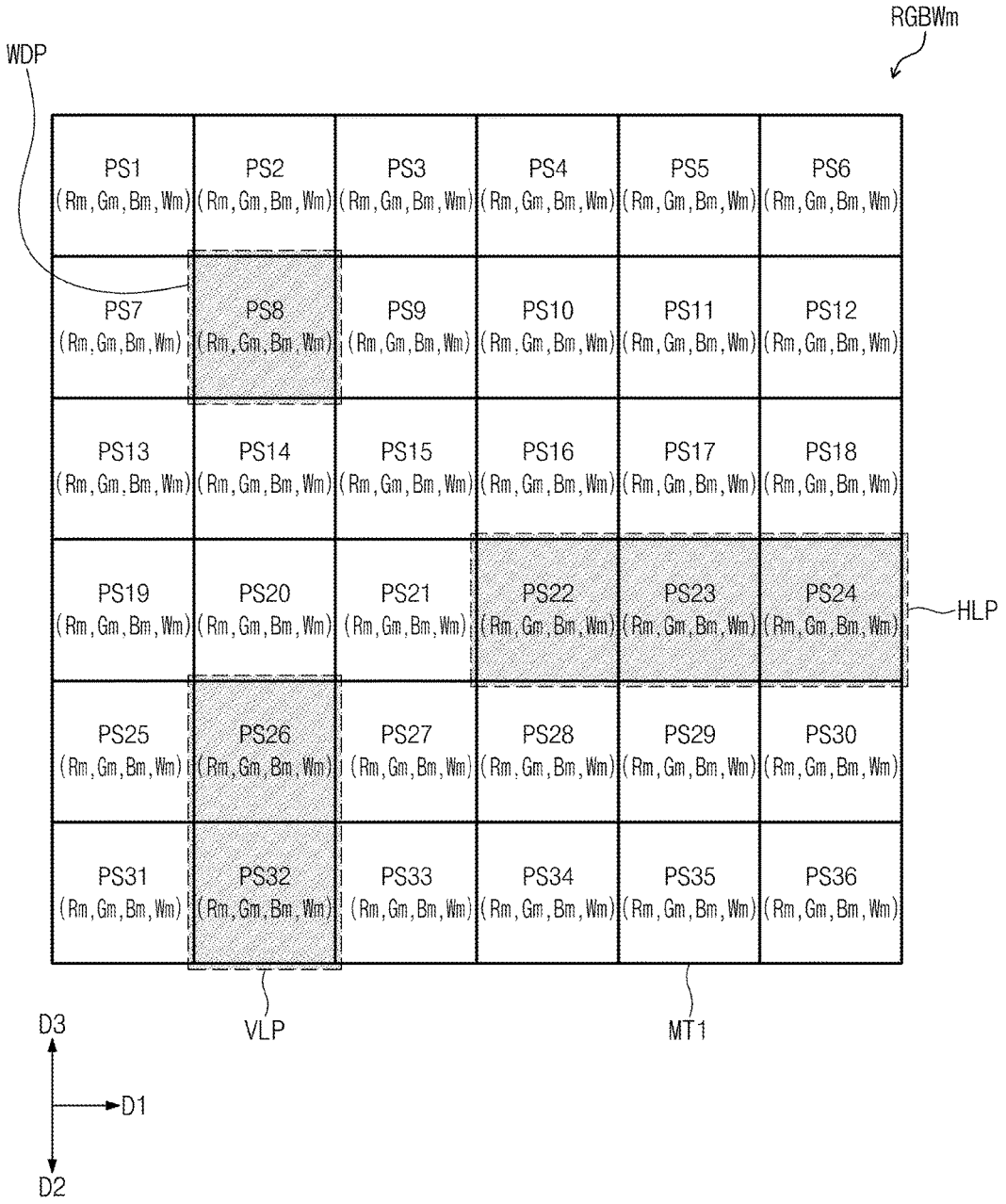
FIG. 15A is a view showing RGBW signals according to another exemplary embodiment of the present disclosure.
Figure 15B:
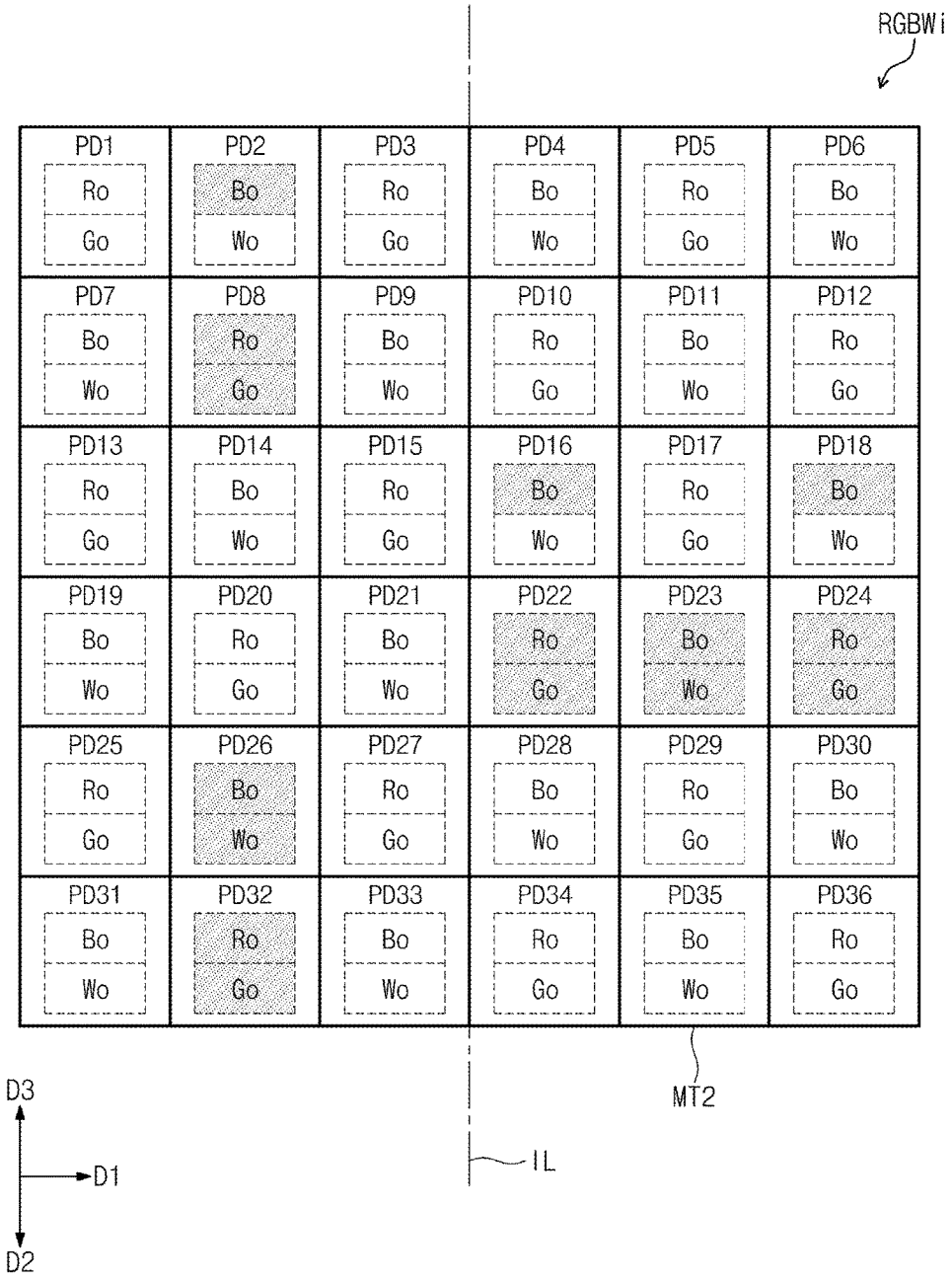
FIG. 15B is a view showing intermediate data generated in accordance with the RGBW signals shown in FIG. 15A.
Figure 15C:
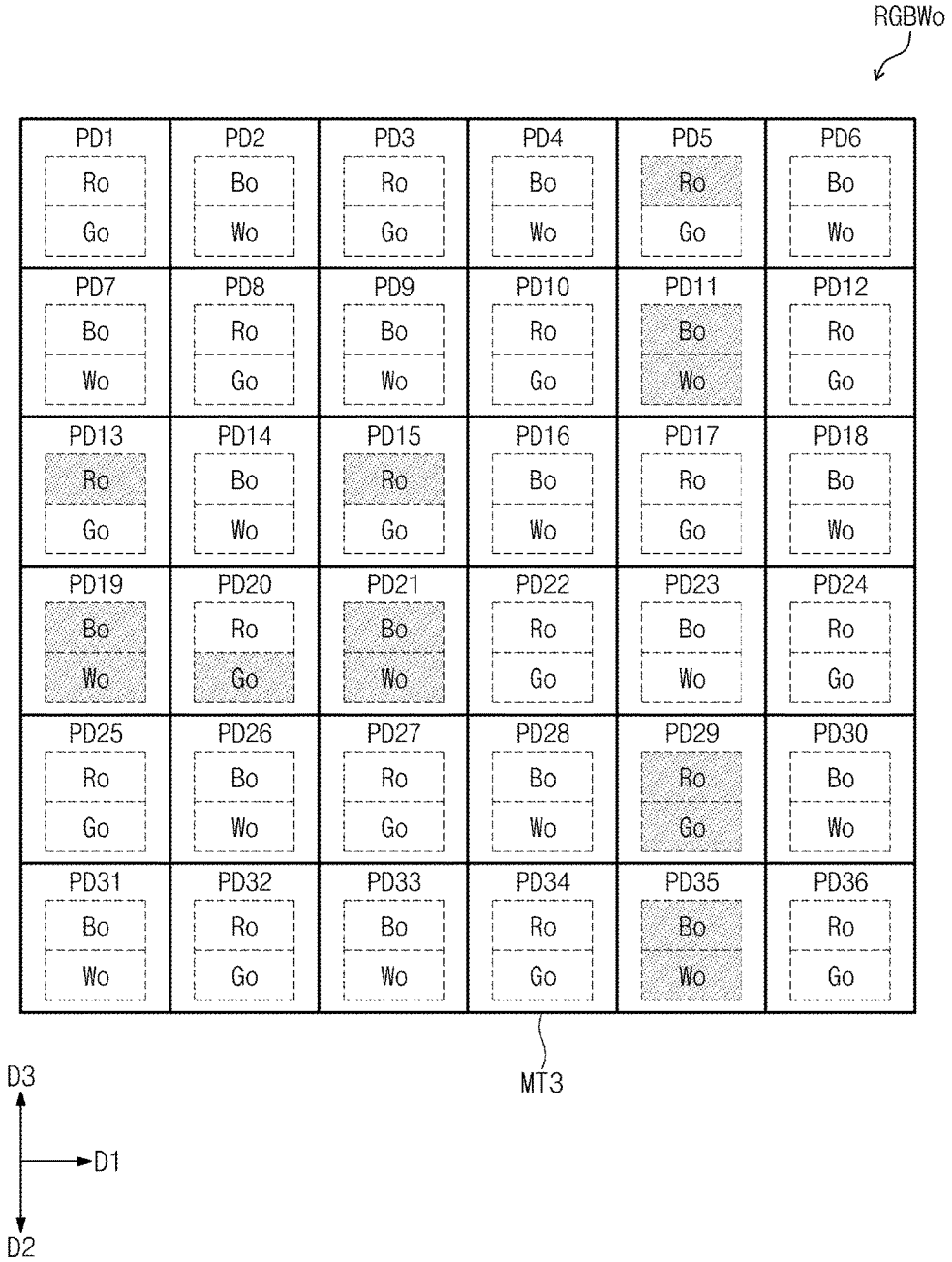
FIG. 15C is a view showing output image data generated in accordance with the intermediate data shown in FIG. 15B.
Figure 15D:
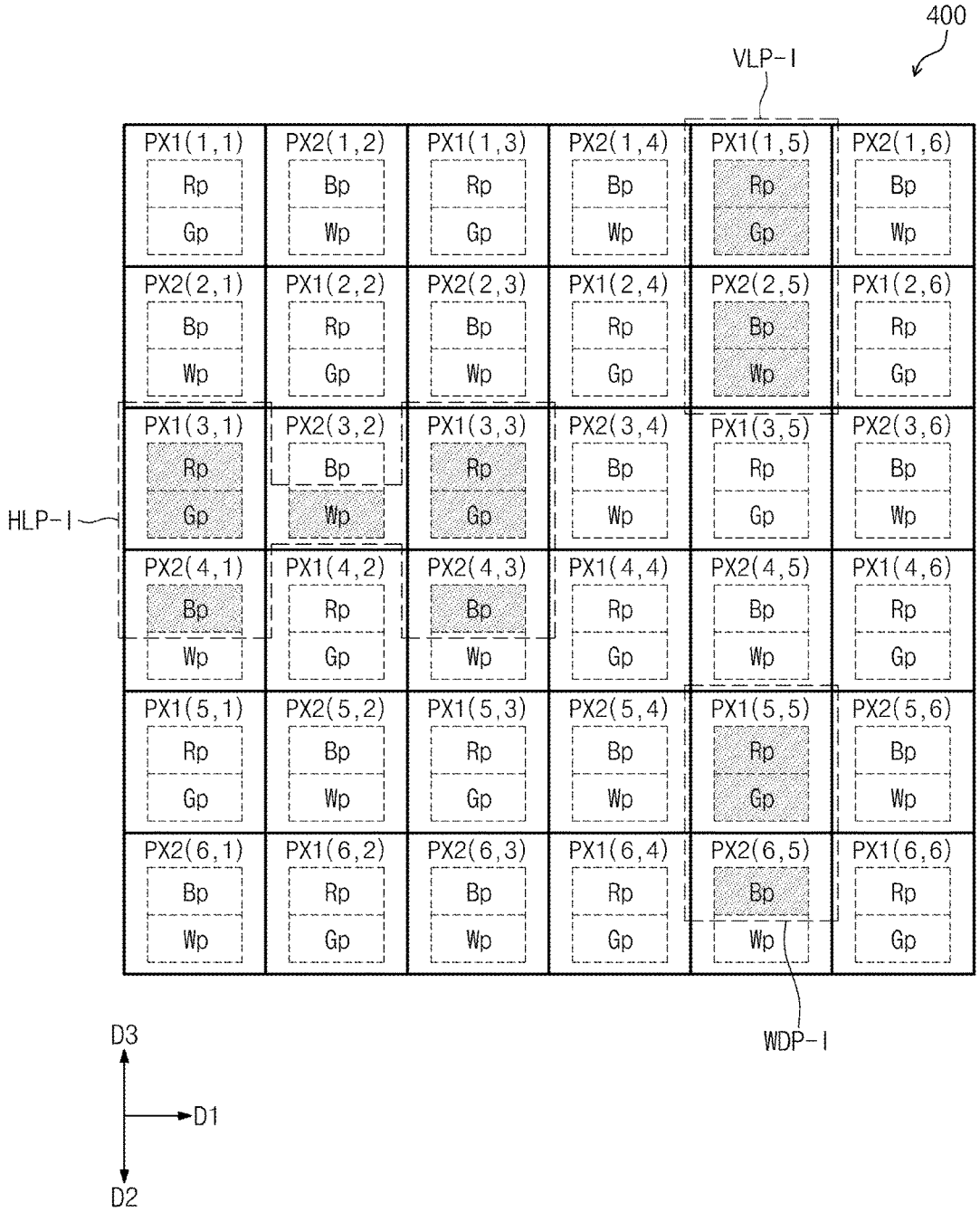
FIG. 15D is a view showing a portion of a display panel that displays an image according to the output image data shown in FIG. 15C.

FIG. 15A is a view showing RGBW signals according to another exemplary embodiment of the present disclosure, FIG. 15B is a view showing intermediate data generated in accordance with the RGBW signals shown in FIG. 15A, FIG. 15C is a view showing output image data generated in accordance with the intermediate data shown in FIG. 15B, and FIG. 15D is a view showing a portion of a display panel that displays an image according to the output image data shown in FIG. 15C.

Referring to FIG. 15A, the pixel signals of the RGBW signal RGBWm are defined in a first matrix space MT1 arranged as six rows by six columns. The RGBW signal RGBWm includes a white dot pattern WDP, a horizontal white line pattern HLP, and a vertical white line pattern VLP. The pixel signals not included in the white dot pattern WDP, the horizontal white line pattern HLP, and the vertical white line pattern VLP have a value corresponding to zero (0) grayscale.

Then, intermediate data RGBWi are generated using the re-sample filter RSF as shown in FIG. 15B. Pixel data of the intermediate data RGBWi are defined in a second 6×6 matrix space MT2.

In more detail, the green and red pixel data Go and Ro of the eighth, twenty-second, twenty-fourth, and thirty-second pixel data PD8, PD22, PD24, and PD32 are generated using the re-sample filter RSF (refer to FIG. 10) in which the eighth, twenty-second, twenty-fourth, and thirty-second pixel signals PS8, PS22, PS24, and PS32 are designated as the target pixel signal.

The white pixel data Wo of the twenty-third and twenty-sixth pixel data PD23 and PD26 are generated using the re-sample filter RSF in which the twenty-third and twenty-sixth pixel signals PS23 and PS26 are designated as the target pixel signal.

The blue pixel data Bo of the second, sixteenth, eighteenth, twenty-third, and twenty-sixth pixel data PD2, PD16, PD18, PD23, and PD26 are generated using the re-sample filter RSF in which the eighth, twenty-second, twenty-fourth, twenty-ninth, and thirty-second pixel signals PS8, PS22, PS24, PS29, and PS32 are designated as the target pixel signal.

Then, the timing controller 100 (refer to FIG. 1) swaps or reflects the pixel data as viewed relative to an imaginary line IL crossing a center of the second matrix space MT2 and substantially parallel to the column direction, to generate the output image data RGBWo. The pixel data of the output image data RGBWo are defined in a third 6×6 matrix space MT3.

In more detail, the pixel data of the intermediate data RGBWi, which are provided in a q-th row, are mapped to be in a p-(q+1)th row of the output image data RGBWo. Here, "p" denotes the number of rows included in the first and second intermediate data RGBWi and the output image data RGBWo, and is thus equal to six (6).

For instance, the blue pixel data Bo of the second pixel data PD2 of the first row and the second column are mapped to the red pixel data Ro of the fifth pixel data PD5 of the first row and the fifth column in the output image data RGBWo.

Referring to FIG. 15D, the gate signals are sequentially applied to the gate lines GL1 to GLn (refer to FIG. 13) from the n-th gate line GLn to the first gate line GL1. That is, the gate signals are sequentially applied to the gate lines GL1 to GLn along the third direction D3.

The data driver 300 applies the output image data RGBWo to the first and second pixels PX1(1,1) to PX1(6,6) and PX2(1,2) to PX2(6,5) by row. Accordingly, the pixels arranged in the r-th row display the image corresponding to the pixel data of the n-(r+1)th row of the output image data RGBWo. Here, "n" is a natural number and denotes the number of rows of the third matrix space MT3. In the present exemplary embodiment, the value of "n" is six (6).

For instance, the first pixel PX1(1,5) of the first pixel row and the fifth pixel column displays the image corresponding to the thirty-fifth pixel data PD35 of the output image data RGBWo. In more detail, the first and second sub-pixels Rp and Gp of the first pixel PX1(1,5) of the first pixel row and the fifth pixel column respectively display images corresponding to grayscale values of the blue and white pixel data Bo and Wo of the thirty-fifth pixel data PD35 of the output image data RGBWo.

As described above, when the image is displayed using the generated output image data RGBWo, the display apparatus 2000 displays a white dot pattern image WDP-I corresponding to the white dot pattern WDP, a horizontal white line pattern image HLP-I corresponding to the horizontal white line pattern HLP, and a vertical white line pattern image VLP-I corresponding to the vertical white line pattern VLP without distortion.

In more detail, the red and green images displayed through the first and second sub-pixels Rp and Gp of the first pixel PX1(3,1) of the third pixel row and the first pixel column, the blue image displayed through the third sub-pixel Bp of the second pixel PX2(4,1) of the fourth pixel row and the first pixel column, the white image displayed through the fourth sub-pixel Wp of the second pixel PX2(3,2) of the third pixel row and the second pixel column, the red and green images displayed through the first and second sub-pixels Rp and Gp of the first pixel PX1(3,3) of the third pixel row and the third pixel column, and the blue image displayed through the third sub-pixel Bp of the second pixel PX2(4,3) of the fourth pixel row and the third pixel column collectively form the horizontal white line pattern image HLP-I.

The red and green images displayed through the first and second sub-pixels Rp and Gp of the first pixel PX1(1,5) of the first pixel row and the fifth pixel column and the blue and white images displayed through the third and fourth sub-pixels Bp and Wp of the second pixel PX2(2,5) of the second pixel row and the fifth pixel column together act to display the vertical white line pattern image VLP-I.

The red and green images displayed through the first and second sub-pixels Rp and Gp of the first pixel PX1(5,5) of the fifth pixel row and the fifth pixel column and the blue image displayed through the third sub-pixel Bp of the second pixel PX2(6,5) of the sixth pixel row and the fifth pixel column together act to display the white dot pattern image WDP-I.

As described above, when the white dot pattern image WDP-I, the horizontal white line pattern image HLP-I, and the vertical white line pattern image VLP-I are displayed while the upper and lower portions of the display apparatus 2000 (refer to FIG. 13) are reversed, the images corresponding to the white dot pattern WDP, the horizontal white line pattern HLP, and the vertical white line pattern VLP are perceived by a user.

When the output image data RGBWo are generated through the above-mentioned data processing and the display panel 400 is operated using the output image data RGBWo, the red, green, and blue images are sequentially displayed in the column direction. Accordingly, the color reproducibility of the white or mixed-color is increased and the white image is prevented from being distorted. As a result, the display quality of the image displayed in the display panel 400 is improved.

Figure 16:
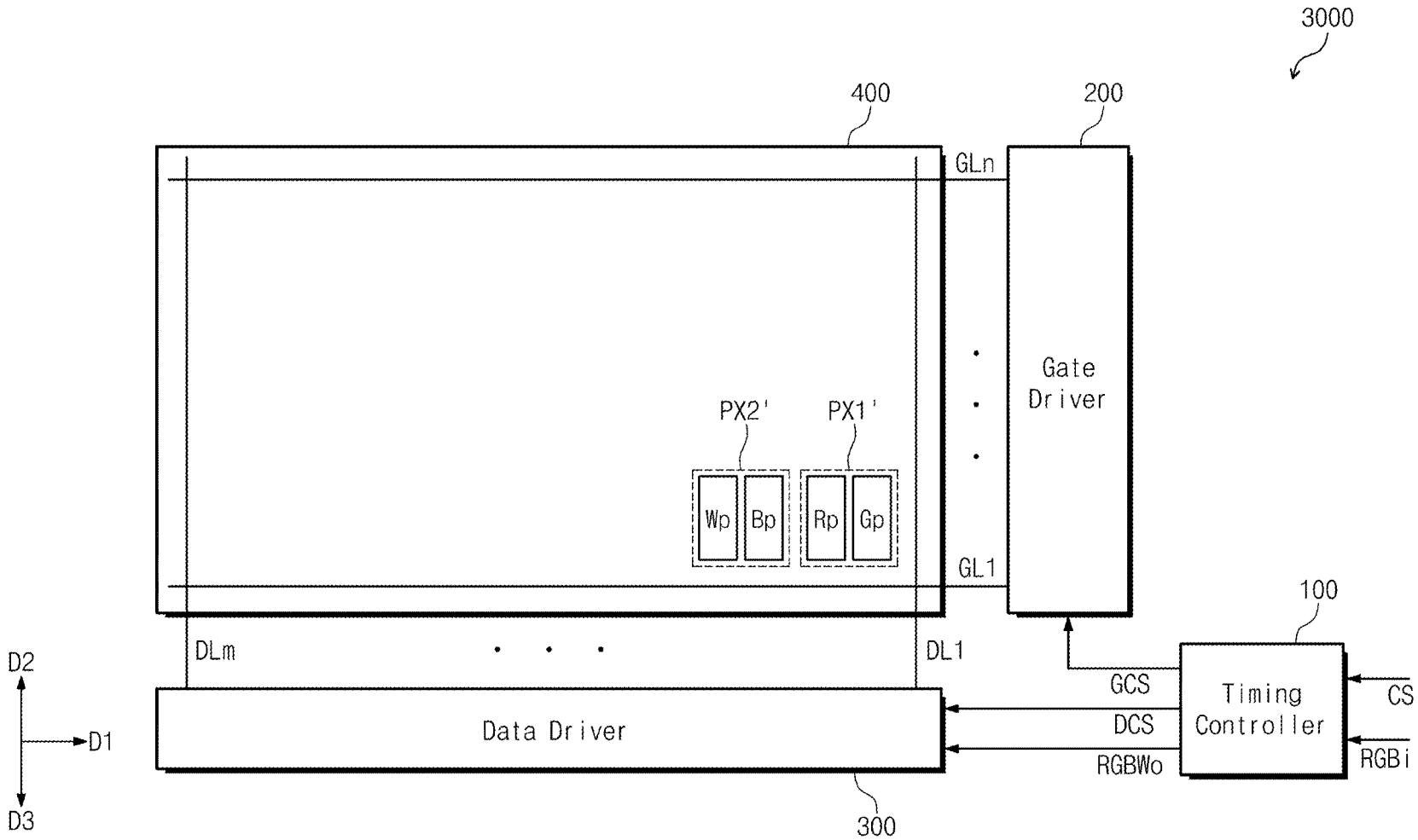
FIG. 16 is a block diagram showing a display apparatus according to another exemplary embodiment of the present disclosure.

FIG. 16 is a block diagram showing a display apparatus 3000 according to another exemplary embodiment of the present disclosure.

The display apparatus 3000 shown in FIG. 16 is substantially the same as the display apparatus 2000 shown in FIG. 13, except that the display apparatus 3000 includes first and second pixels PX1' and PX2' each having a structure different from that of the first and second pixels PX1 and PX2 shown in FIG. 13, and is operated in the up-and-down inversion driving scheme.

Referring to FIG. 16, the display apparatus 3000 is operated in the up-and-down inversion driving scheme described with reference to FIG. 13.

The display apparatus 3000 includes a plurality of gate lines GL1 to GLn, a plurality of data lines DL1 to DLm, and the first and second pixels PX1' and PX2' arranged in areas defined by the gate lines GL1 to GLn and the data lines DL1 to DLm.

The first pixel PX1' includes first and second sub-pixels Rp and Gp arranged along the first direction D1, and the second pixel PX2' includes third and fourth sub-pixels Bp and Wp arranged along the first direction D1.

Each of the first, second, third, and fourth sub-pixels Rp, Gp, Bp, and Wp has a substantially rectangular shape with short sides extending in the first direction D1 and long sides extending in the second direction D2. The long sides of the first, second, third, and fourth sub-pixels Rp, Gp, Bp, and Wp are longer than the short sides of the first, second, third, and fourth sub-pixels Rp, Gp, Bp, and Wp. The first, second, third, and fourth sub-pixels Rp, Gp, Bp, and Wp respectively display red, green, blue, and white colors.

Each of the first, second, third, and fourth sub-pixels Rp, Gp, Bp, and Wp is connected to a corresponding gate line of the gate lines GL1 to GLn and a corresponding data line of the data lines DL1 to DLm, and is independently operated. The first, second, third, and fourth sub-pixels Rp, Gp, Bp, and Wp may be connected to the same gate line of the gate lines GL1 to GLn.

Figure 17A:
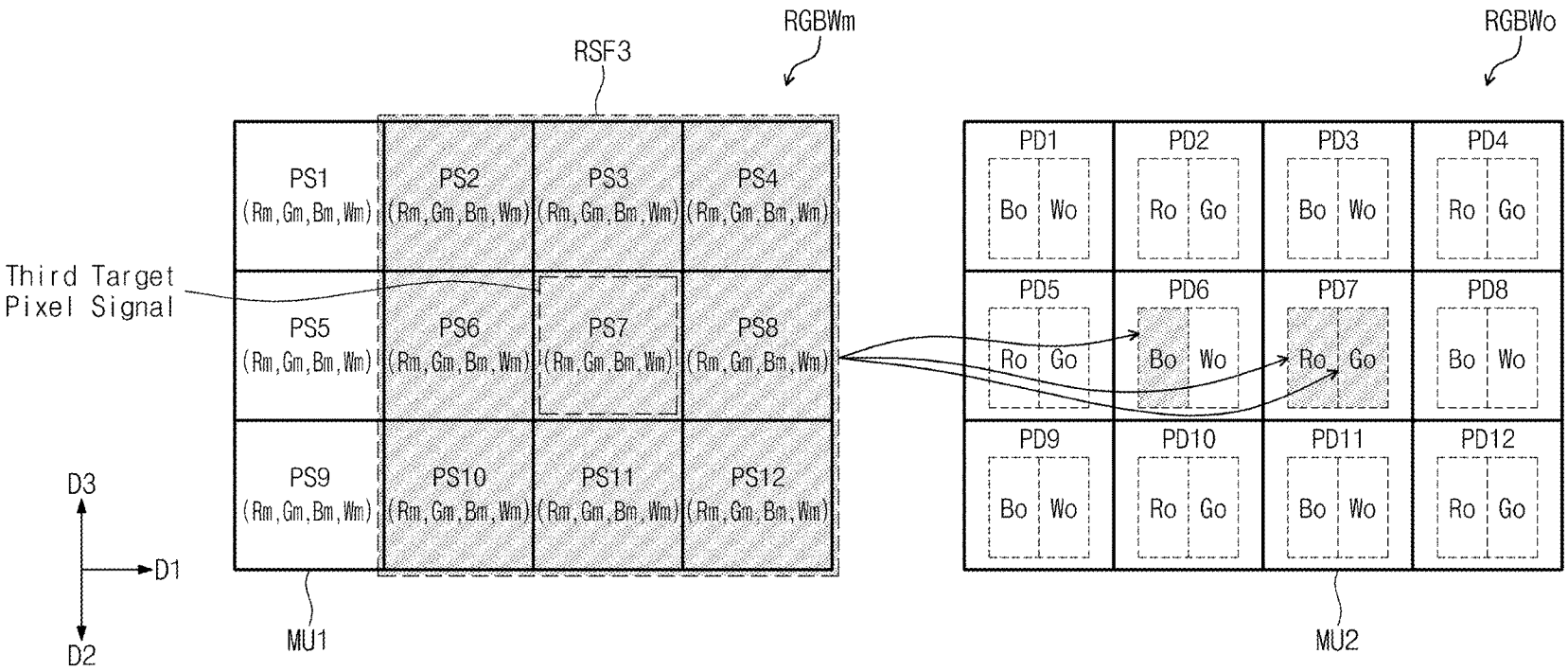
FIGS. 17A and 17B are views showing the generation of pixel data according to another exemplary embodiment of the present disclosure.
Figure 17B:
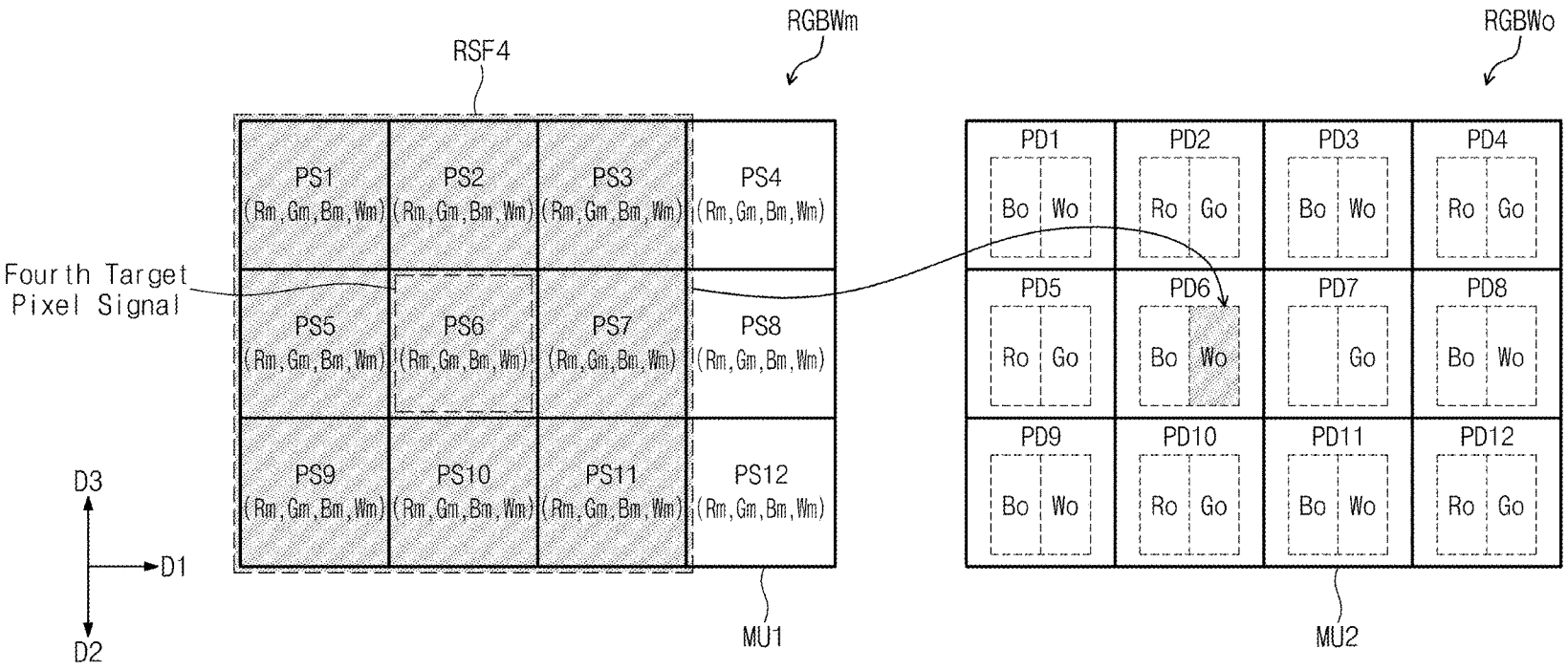

FIGS. 17A and 17B are views showing pixel data generation according to another exemplary embodiment of the present disclosure.

The generation of pixel data according to the present exemplary embodiment is substantially the same as the pixel data generation described with reference to FIGS. 11A and 11B, except for the generating of blue pixel data.

That is, the red and green pixel data Ro and Go are generated using the re-sample filter RSF where the pixel signals corresponding to red and green pixel data Ro and Go are designated as target pixel signals. For instance, the red and green pixel data Ro and Go of the seventh pixel data PD7 are generated using a third re-sample filter RSF3 in which the seventh pixel signal PS7 is designated as a third target pixel signal.

In addition, the white pixel data Wo are generated using the re-sample filter RSF in which the pixel signals corresponding to white pixel data Wo are designated as target pixel signals. For instance, the white pixel data Wo of the sixth pixel data PD6 are generated using a fourth re-sample filter RSF4 in which the sixth pixel signal PS6 is designated as a fourth target pixel signal.

Meanwhile, the blue pixel data Bo are generated using a re-sample filter RSF that is moved over one pixel in direction D1 from the target pixel of fourth re-sample filter RSF4. In this case, the re-sample filter RSF used is the same as that used for the red and green pixel data Ro and Go, i.e. third re-sample filter RSF3. That is, the blue pixel data Bo of the sixth pixel data PD6 are generated using the third re-sample filter RSF3 in which the seventh pixel signal PS7 is designated as the third target pixel signal.

Figure 18A:
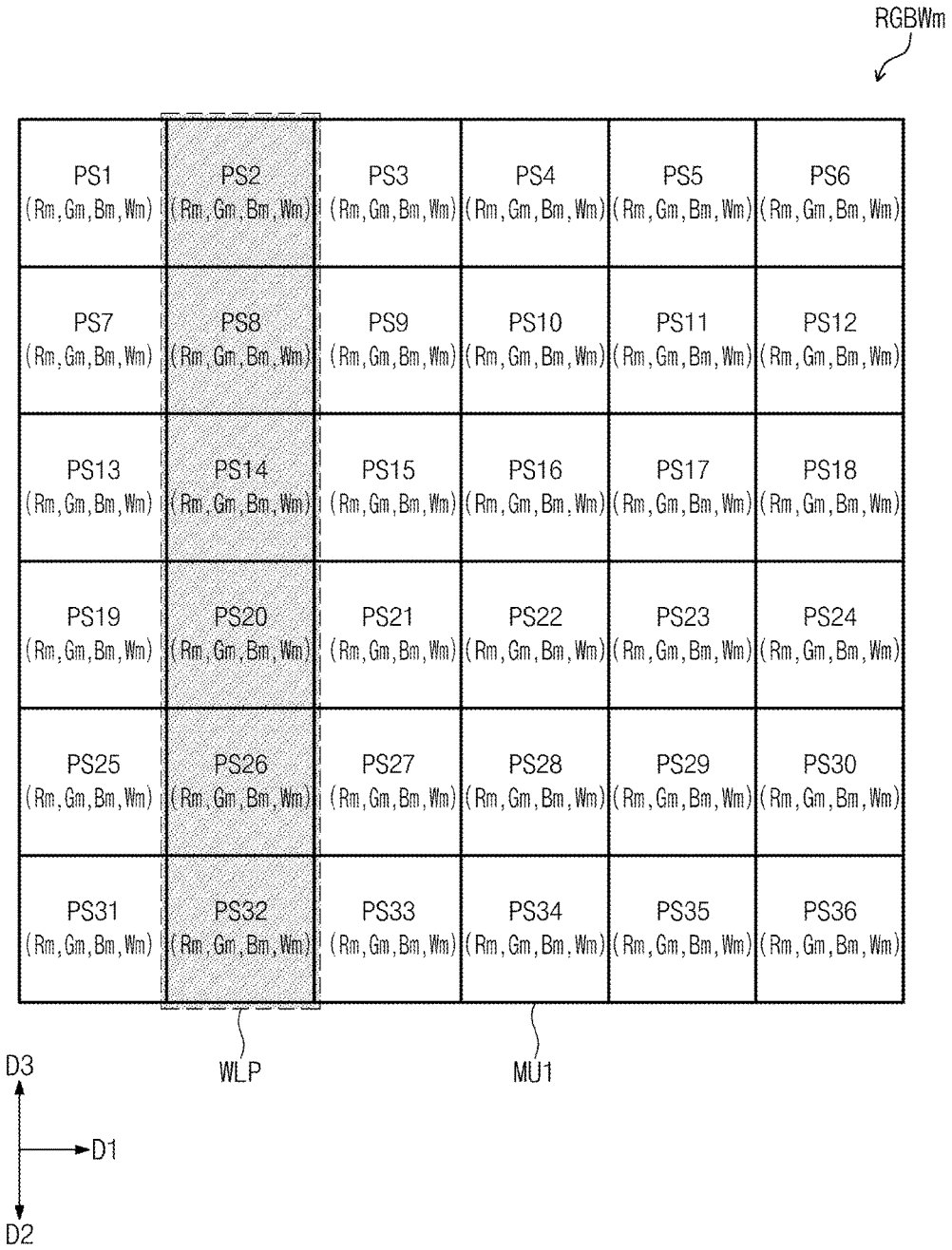
FIG. 18A is a view showing RGBW signals according to another exemplary embodiment of the present disclosure.
Figure 18B:
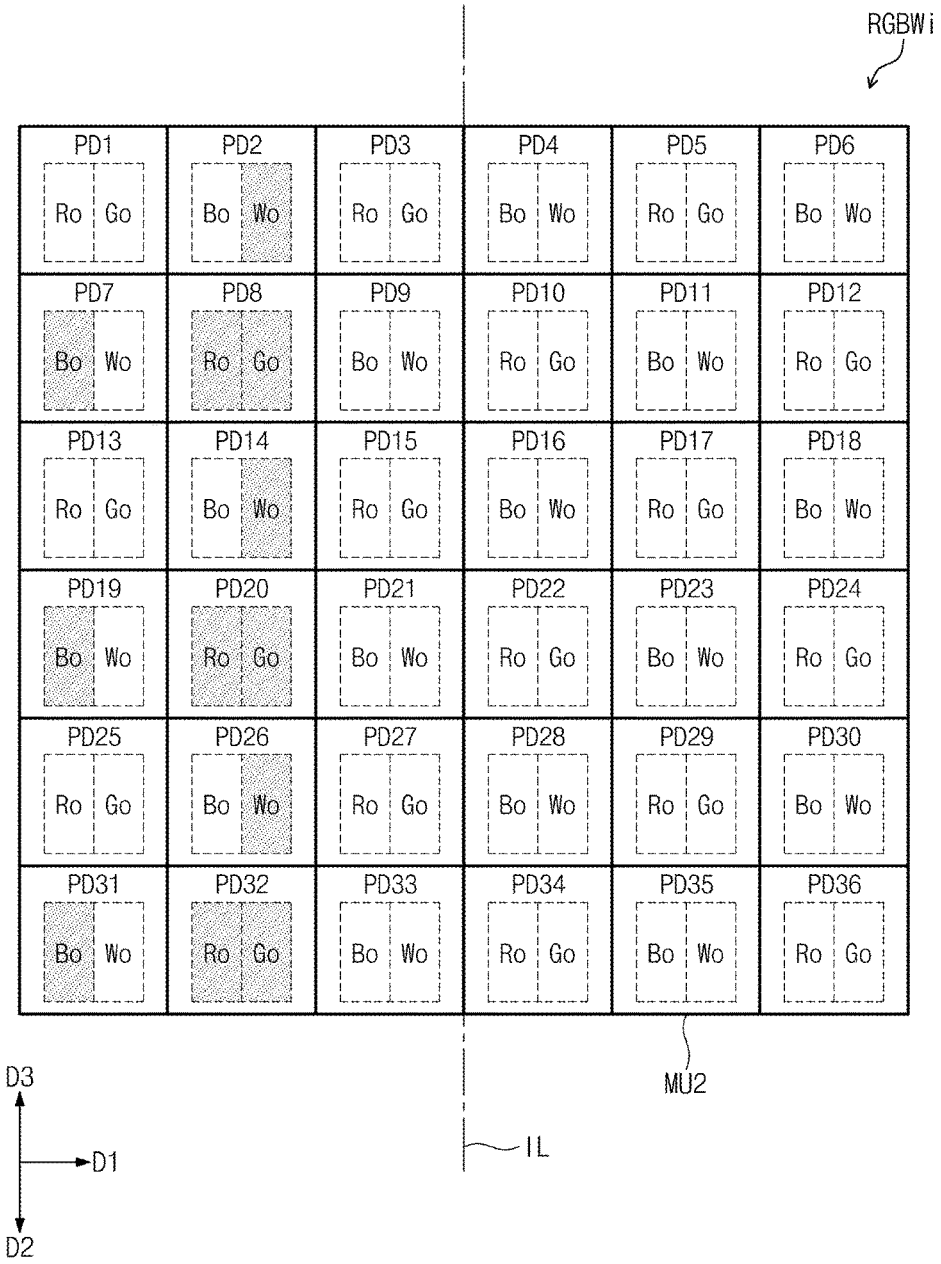
FIG. 18B is a view showing intermediate data generated in accordance with the RGBW signals shown in FIG. 18A.
Figure 18C:
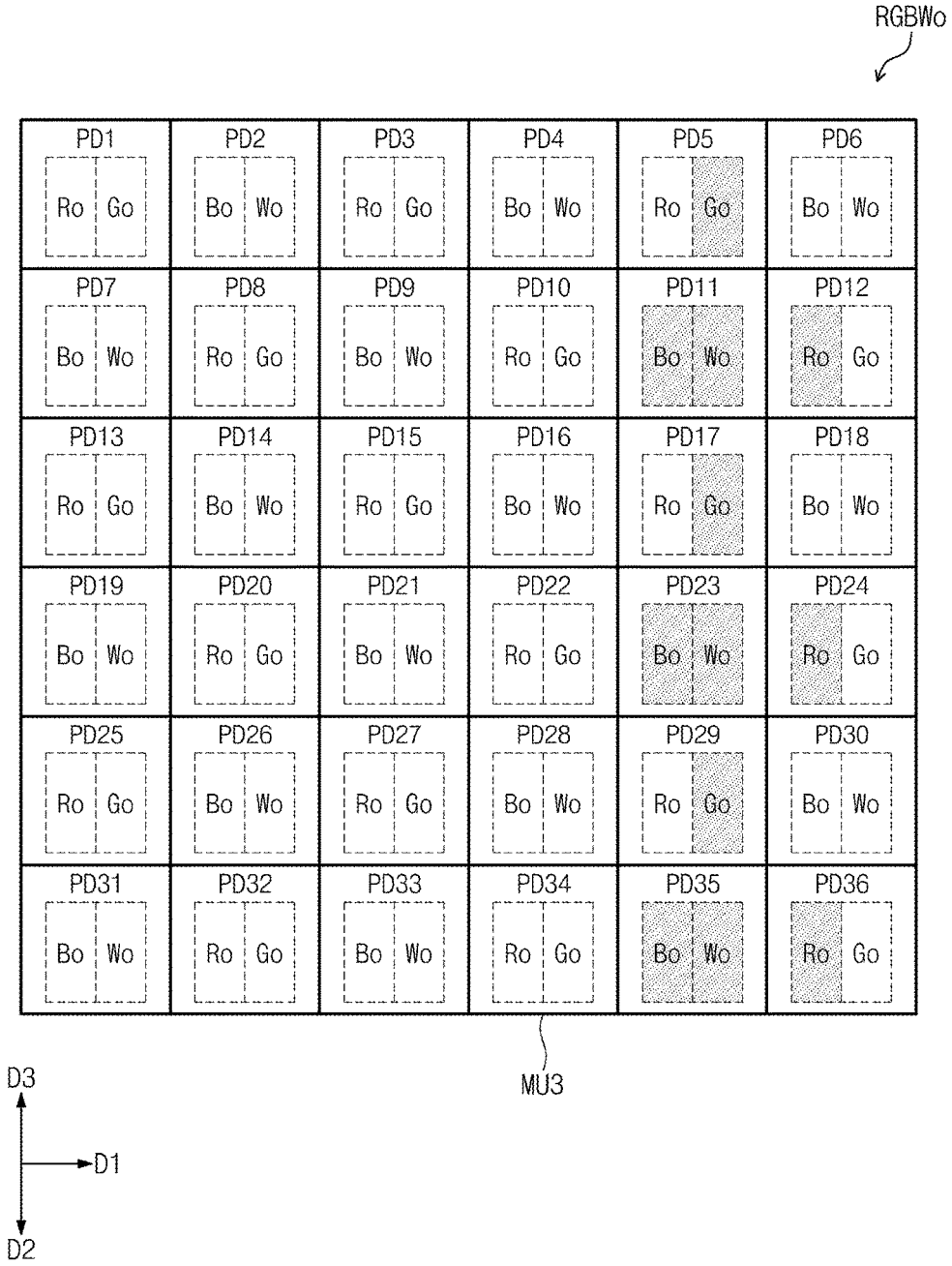
FIG. 18C is a view showing output image data generated in accordance with the intermediate data shown in FIG. 18B.
Figure 18D:
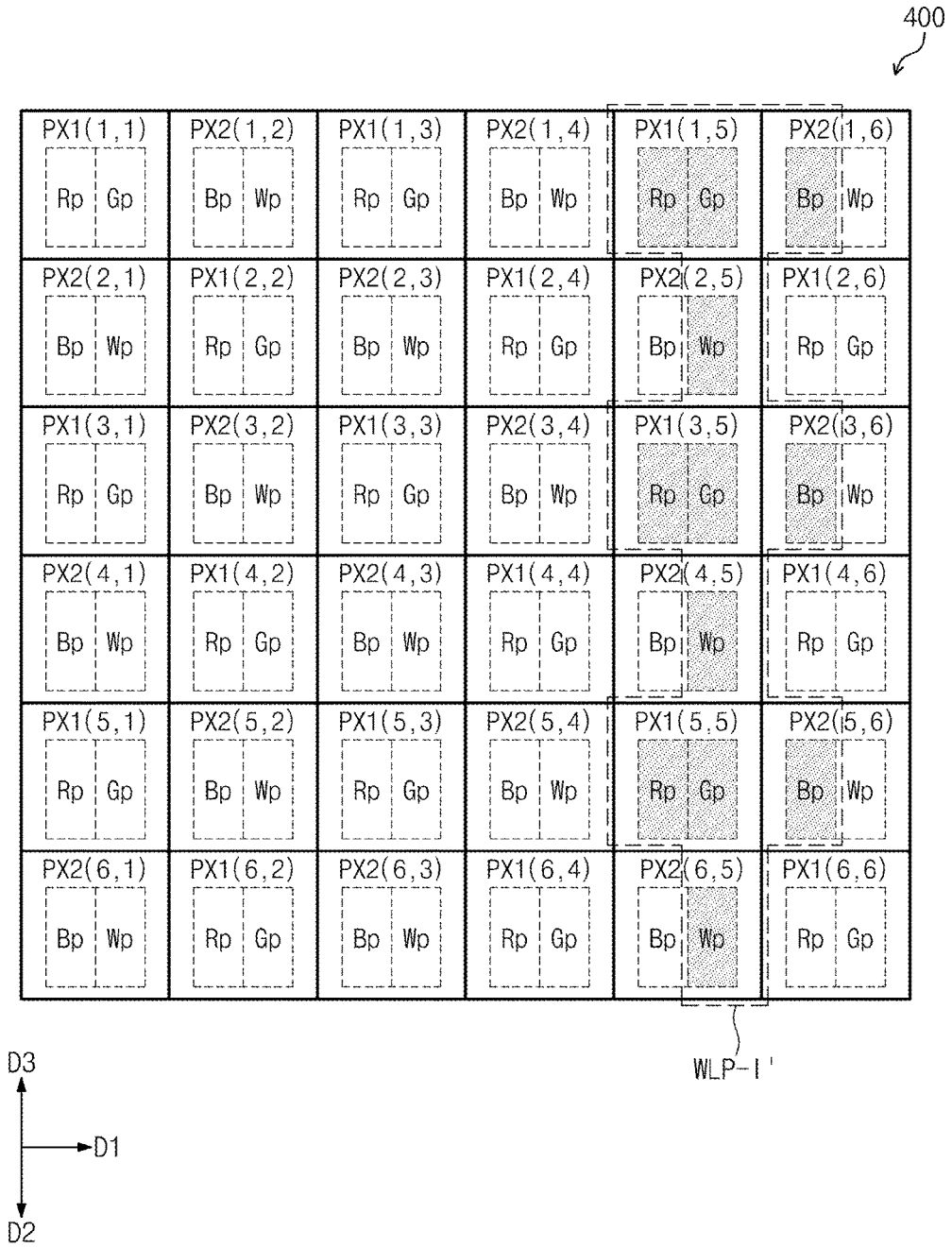
FIG. 18D is a view showing a portion of a display panel that displays an image according to the output image data shown in FIG. 18C.

FIG. 18A is a view showing RGBW signals according to another exemplary embodiment of the present disclosure, FIG. 18B is a view showing intermediate data generated in accordance with the RGBW signals shown in FIG. 18A, FIG. 18C is a view showing output image data generated in accordance with the intermediate data shown in FIG. 18B, and FIG. 18D is a view showing a portion of a display panel that displays an image according to the output image data shown in FIG. 18C.

Referring to FIG. 18A, the pixel signals of the RGBW signal RGBWm are defined in a first matrix space MU1 of six rows by six columns. The RGBW signal RGBWm has a white line pattern WLP. The white line pattern WLP is provided along a second column of the first matrix space MU1. Pixel information not included in the white line pattern WLP has values corresponding to a black image.

As shown in FIG. 18B, the intermediate data RGBWi are generated using the re-sample filter RSF. Like the RGBW signal RGBWm, pixel data of the intermediate data RGBWi are defined in a second matrix space MU2 of six rows by six columns.

In more detail, the green and red pixel data Go and Ro of the eighth, twentieth, and thirty-second pixel data PD8, PD20, and PD32 are generated using the re-sample filter RSF (refer to FIG. 10) in which the eighth, twentieth, and thirty-second pixel signals PS8, PS20, and PS32 are designated as the target pixel signals.

The white pixel data Wo of the second, fourteenth, and twenty-sixth pixel data PD2, PD14, and PD26 are generated using the re-sample filter RSF in which the second, fourteenth, and twenty-sixth pixel signals PS2, PS14, and PS26 are designated as the target pixel signals.

The blue pixel data Bo of the seventh, nineteenth, and thirty-first pixel data PD7, PD19, and PD31 are generated using the re-sample filter RSF in which the eighth, twentieth, and thirty-second pixel signals PS8, PS20, and PS32 are designated as the target pixel signals.

Then, as shown in FIG. 18C, the timing controller 100 (refer to FIG. 16) swaps or reflects the pixel data relative to an imaginary line IL crossing a center of the second matrix space MU2 and substantially parallel to the column direction, to generate the output image data RGBWo. The pixel data of the output image data RGBWo are defined in a third matrix space MU3 of six rows by six columns.

In more detail, the pixel data of the intermediate data RGBWi, which are provided in a q-th row, are mapped to be in a p-(q+1)th row of the output image data RGBWo. Here, "p" denotes the number of rows included in the first and second intermediate data RGBWi and the output image data RGBWo, and is thus equal to six (6).

For instance, the white pixel data Wo of the second pixel data PD2 of the first row and the second column are mapped to the green pixel data Go of the fifth pixel data PD5 of the first row and the fifth column in the output image data RGBWo.

Referring to FIG. 18D, the gate signals are sequentially applied to the gate lines GL1 to GLn (refer to FIG. 16) from the n-th gate line GLn to the first gate line GL1. That is, the gate signals are sequentially applied to the gate lines GL1 to GLn along the third direction D3.

The data driver 300 applies the output image data RGBWo to the first and second pixels PX1(1,1) to PX1(6,6) and PX2(1,2) to PX2(6,5) by row. Accordingly, the pixels arranged in the r-th ("r" is a natural number) row display the image corresponding to the pixel data of the n-(r+1)th row of the output image data RGBWo. Here, "n" is a natural number and denotes the number of rows of the third matrix space MU3. In the present exemplary embodiment, "n" is six (6).

For instance, the second pixel PX2(6,5) of the sixth pixel row and the fifth pixel column displays the image corresponding to the fifth pixel data PD5 of the output image data RGBWo. In more detail, the fourth sub-pixel Wp of the second pixel PX2(6,5) of the sixth pixel row and the fifth pixel column displays the image corresponding to the green pixel data Go of the fifth pixel data PD5 of the output image data RGBWo.

As described above, when an image is displayed using the generated output image data RGBWo, the display apparatus 3000 displays a white line pattern image WLP-I corresponding to the white line pattern WLP shown in FIG. 12A without distortion.

In more detail, the red, green, and white images displayed through the first, second, and fourth sub-pixels Rp, Gp, and Wp arranged in the fifth pixel column and the blue image displayed through the third sub-pixel Bp arranged in the sixth pixel column are mixed with each other to display the white line pattern image WLP-I'.

As described above, when the white line pattern image WLP-I' is displayed while the upper and lower portions of the display apparatus 3000 (refer to FIG. 16) are reversed, the image corresponding to the white line pattern WLP (refer to FIG. 20) is perceived correctly by a user.

When the output image data RGBWo are generated through the above-mentioned data processing and the display panel 400 is operated using the output image data RGBWo, the red, green, and blue images are sequentially displayed in the column direction. Accordingly, the color reproducibility of a white or mixed-color is increased and the white image is prevented from being distorted. As a result, the display quality of the image displayed in the display panel 400 is improved.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed. Furthermore, different features of the various embodiments, disclosed or otherwise understood, can be mixed and matched in any manner to produce further embodiments within the scope of the invention.

What is claimed is:

1. A display apparatus comprising:

a display panel comprising a plurality of gate lines which extend in a row direction, a plurality of data lines which extend in a column direction, and a plurality of pixels arranged in a matrix form, the pixels comprising first pixels and second pixels respectively disposed adjacent to the corresponding first pixels in the column direction, each of the first pixels comprising first and second sub-pixels sequentially arranged along the column direction and each of the second pixels comprising third and fourth sub-pixels sequentially arranged along the column direction;

a timing controller to generate pixel data from pixel signals comprising first and second pixel signals representable in a first matrix space to respectively correspond to the first and second pixels, the pixel data comprising first and second pixel data representable in a second matrix space to respectively correspond to the first and second pixels, the second pixel data being generated on the basis of the first pixel signal adjacent to the second pixel signal and pixel signals of pixels which surround the first pixel in the first matrix space; and a data driver to convert the first and second pixel data to first and second data voltages, respectively, and to apply the first and second data voltages to the first and second pixels.

2. The display apparatus of claim 1, wherein each of the first and second pixel signals comprises first, second, third, and fourth color signals each representing values for different colors, and wherein the first pixel data comprise first and second color data, and the second pixel data comprise third and fourth color data.

3. The display apparatus of claim 2, wherein the third color data of the second pixel data are generated on the basis of the first pixel signal adjacent to the second pixel signal which correspond to each second pixel data in the column direction in the first matrix space, and the fourth color data of the second pixel data are generated on the basis of the second pixel signal.

4. The display apparatus of claim 3, wherein the first pixel data are generated on the basis of the first pixel signal.

5. The display apparatus of claim 4, wherein the first color data of the first pixel data are generated on the basis of the first color signal of the first pixel signal, and the second color data of the first pixel data are generated on the basis of the second color signal of the first pixel signal.

6. The display apparatus of claim 2, wherein the first, second, third, and fourth sub-pixels are connected to different ones of the gate lines, respectively.

7. The display apparatus of claim 2, wherein the timing controller comprises:

a gamut mapping part to map image information having color values for three primary colors, so as to generate the first and second pixel signals; and a sub-pixel rendering part to perform a converting of the first and second pixel signals to the first and second pixel data using a re-sample filter, wherein the first and second pixel signals are adjacent to each other in the column direction of the first matrix space, and wherein the converting further comprises designating the first pixel adjacent to the second pixel in the column direction in the first matrix space as the target pixel signal of the re-sample filter to determine the second pixel data.

8. The display apparatus of claim 7, wherein the sub-pixel rendering part is further arranged to generate the third color data of the second pixel data using the re-sample filter with the first pixel signal adjacent to the second pixel which correspond to each second pixel data in the column direction in the first matrix space designated as the target pixel, and wherein the sub-pixel rendering part is further arranged to generate the fourth color data of the second pixel data using the re-sample filter with the second pixel signal in the first matrix space as the target pixel.

9. The display apparatus of claim 8, wherein the sub-pixel rendering part is further arranged to generate the first pixel data using the re-sample filter with the first pixel signal designated as the target pixel signal.

10. The display apparatus of claim 9, wherein the first, second, and third sub-pixels are constructed to display different colors from each other among red, green, and blue colors, and wherein the fourth sub-pixel is constructed to display a white color.

11. The display apparatus of claim 10, wherein the third sub-pixel is constructed to display the blue color.

12. The display apparatus of claim 11, wherein first, second, third, and fourth color signals are red, green, blue, and white color signals, respectively.

13. The display apparatus of claim 8, wherein the re-sample filter is representable as a 3×3 matrix of scale coefficients.

14. The display apparatus of claim 1, wherein the first, second, third, and fourth sub-pixels are disposed between first and second data lines disposed adjacent to each other along the row direction.

15. The display apparatus of claim 1, wherein the first and second sub-pixels are arranged successively along a first direction substantially parallel to the column direction in each of the first pixels, and the third and fourth sub-pixels are arranged successively along the first direction in each of the second pixels.

16. The display apparatus of claim 15, further comprising a gate driver to sequentially apply gate signals to the gate lines, wherein the gate driver is arranged to output the gate signals to allow pixel signals of an r-th (r is a natural number) row of the first matrix space to be applied to pixels arranged in an r-th row among the pixels.

17. The display apparatus of claim 15, further comprising a gate driver to sequentially apply gate signals to the gate lines, wherein the gate driver is arranged to output the gate signals to allow pixel data of an n-(r+1)th (where each of "n" and "r" is a natural number) row of the second matrix space to be applied to pixels arranged in an r-th row among the pixels, wherein the "n" indicates a number of rows in the second matrix space, the timing controller is arranged to reflect the pixel data with respect to an imaginary line which crosses a center of the second matrix space and is oriented substantially parallel to the column direction, and the timing controller is further arranged to apply the reflected pixel data to the data driver, and wherein the second pixel data are generated on the basis of the first pixel signal.

18. A display apparatus comprising:

a display panel comprising a plurality of gate lines which extend in a first direction, a plurality of data lines which extend in a second direction, and a plurality of pixels arranged in a matrix form, the pixels comprising first pixels and second pixels respectively disposed adjacent to the corresponding first pixels in the first direction, each of the first pixels comprising first and second sub-pixels sequentially arranged along the first direction and each of the second pixels comprising third and fourth sub-pixels sequentially arranged along the first direction;

a timing controller constructed to generate pixel data from pixel signals comprising first and second pixel signals representable in a first matrix space to respectively correspond to the first and second pixels, the pixel data comprising first and second pixel data representable in a second matrix space to respectively correspond to the first and second pixels, the second pixel data being generated on the basis of the first pixel signal adjacent to the second pixel signal and pixel signals of pixels which surround the first pixel in the first matrix space; and a gate driver constructed to sequentially apply gate signals to the gate lines, the gate driver to output the gate signals to allow pixel signals of an r-th (r is a natural number) row of the first matrix space to be applied to pixels arranged in an r-th row among the pixels, wherein the timing controller is further constructed to perform a reflection operation on the pixel data about an imaginary line which crosses a center of the second matrix space and which is oriented substantially parallel to the second direction, and to output the reflected pixel data.

19. The display apparatus of claim 18, wherein each of the first and second pixel signals comprises first, second, third, and fourth color signals each representing values for different colors, and wherein the first pixel data comprises first and second color data, and the second pixel data comprises third and fourth color data.

20. The display apparatus of claim 19, wherein the third color data of the second pixel data are generated on the basis of the first pixel signal adjacent to the second pixel signal which correspond to each second pixel data in the column direction in the first matrix space, and the fourth color data of the second pixel data are generated on the basis of the second pixel signal.

21. The display apparatus of claim 19, wherein the first pixel data are generated on the basis of the first pixel signal.

22. The display apparatus of claim 21, wherein the first color data of the first pixel data are generated on the basis of the first color signal of the first pixel signal, and the second color data of the first pixel data are generated on the basis of the second color signal of the first pixel signal.

23. The display apparatus of claim 19, wherein the first, second, third, and fourth sub-pixels are connected to different ones of the gate lines, respectively.

24. The display apparatus of claim 19, wherein the timing controller comprises:

a gamut mapping part to map image information having color values for three primary colors, so as to generate the first and second pixel signals; and a sub-pixel rendering part to perform a converting of the first and second pixel signals to the first and second pixel data using a re-sample filter, wherein the first and second pixel signals are adjacent to each other in the column direction of the first matrix space, and wherein the converting further comprises designating the first pixel signal adjacent to the second pixel signal which correspond to each second pixel data in the column direction in the first matrix space as the target pixel signal of the re-sample filter.

25. The display apparatus of claim 24, wherein the sub-pixel rendering part is further constructed to generate the third color data of the second pixel data using the re-sample filter with the first pixel signal designated as the target pixel signal, and wherein the sub-pixel rendering part is further arranged to generate the fourth color data of the second pixel data using the re-sample filter with the second pixel signal as the target pixel signal.

26. The display apparatus of claim 25, wherein the sub-pixel rendering part is further constructed to generate the first pixel data using the re-sample filter with the first pixel signal designated as the target pixel signal.

27. The display apparatus of claim 26, wherein the first, second, and third sub-pixels are constructed to display different colors from each other among red, green, and blue colors, and wherein the fourth sub-pixel is constructed to display a white color.

28. The display apparatus of claim 27, wherein the third sub-pixel is constructed to display the blue color.

29. The display apparatus of claim 28, wherein first, second, third, and fourth color signals are red, green, blue, and white color signals.

30. The display apparatus of claim 18, wherein the first, second, third, and fourth sub-pixels are disposed between first and second data lines disposed adjacent to each other along the second direction.

* * * * *